US006692371B2

(12) United States Patent
Berish et al.

(10) Patent No.: US 6,692,371 B2
(45) Date of Patent: Feb. 17, 2004

(54) STABILIZED GOLF CLUB

(76) Inventors: James Edward Berish, 1516 N. 12th Ave., Durant, OK (US) 74701; George M. Berish, 1516 N. 12th Ave., Durant, OK (US) 74701; Rudoph John Buchel, Jr., 7113 Dobbins Dr., Plano, TX (US) 75025

( * ) Notice: Subject to any disclaimer, the term of this patent is extended or adjusted under 35 U.S.C. 154(b) by 0 days.

(21) Appl. No.: 09/811,947

(22) Filed: Mar. 19, 2001

(65) Prior Publication Data

US 2002/0177489 A1 Nov. 28, 2002

(51) Int. Cl.[7] ..... A63B 53/02

(52) U.S. Cl. ..... 473/244; 473/246; 473/313; 473/314; 473/341

(58) Field of Search ..... 473/334, 242, 473/243, 244, 245, 246, 248, 313, 314, 340, 341

(56) References Cited

U.S. PATENT DOCUMENTS

| | | | | |
|---|---|---|---|---|
| D188,857 | S | * | 9/1960 | Mospan |
| 4,655,459 | A | * | 4/1987 | Antonious |
| 4,736,951 | A | * | 4/1988 | Grant |
| 4,902,015 | A | * | 2/1990 | Nebbia |
| 5,340,104 | A | | 8/1994 | Griffin |
| 5,346,219 | A | * | 9/1994 | Pehoski et al. |
| 5,390,918 | A | | 2/1995 | Meyers et al. |
| 5,511,779 | A | | 4/1996 | Meyers et al. |
| 5,533,730 | A | | 7/1996 | Ruvang |
| 5,716,287 | A | | 2/1998 | Levocz et al. |
| 5,722,177 | A | * | 3/1998 | Reilly, III |
| 5,820,481 | A | * | 10/1998 | Raudman |
| 5,863,257 | A | | 1/1999 | Busnardo |
| 5,921,871 | A | * | 7/1999 | Fisher |
| 6,001,024 | A | * | 12/1999 | Van Alen, II et al. |
| 6,033,319 | A | * | 3/2000 | Farrar |
| 6,125,555 | A | | 10/2000 | Schenkel |
| 6,267,689 | B1 | * | 7/2001 | Ambrose |

* cited by examiner

*Primary Examiner*—Stephen Blau

(57) ABSTRACT

The present invention relates to golf clubs, more particularly to a stabilized golf club that accounts for human factors in its design and configuration. In accordance with one embodiment a berish bracket is attached to two points on a club head for increased controllability The shaft attaches to the berish and provides the force necessary to propel the ball forward but, due to the configuration of the berish bracket, the forces is applied at two points along the club head. In accordance with another embodiment, the club shaft is configured to point forward of the moment of mass of the club head, thereby further increasing controllability In accordance with other embodiments, a configurable knuckle is configured between the club shaft and the berish bracket for is optimizing controllability for an individual golfer. In addition to optimizing controllability, the configurable knuckle provides for six-degrees-adjustability thereby allowing a club to be reconfigured to handle and feel similar to other clubs by articulating adjustments on the knuckle to predetermined adjustment settings.

120 Claims, 21 Drawing Sheets

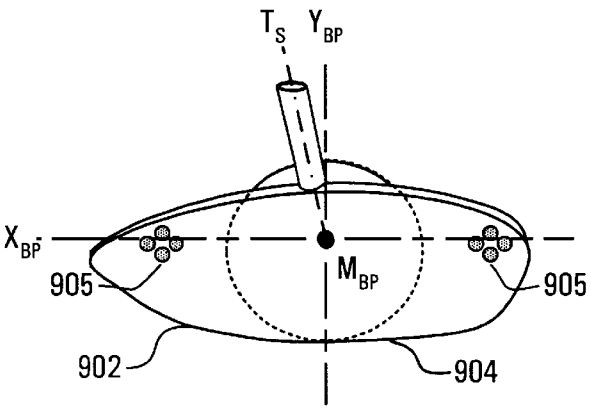
FIG. 9
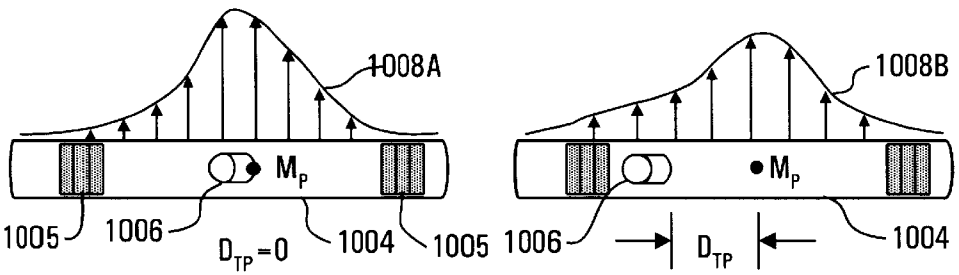
FIG. 10A
FIG. 10B
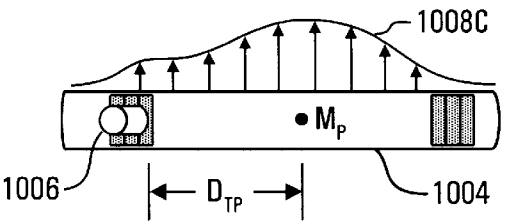
FIG. 10C

FIG. 19A
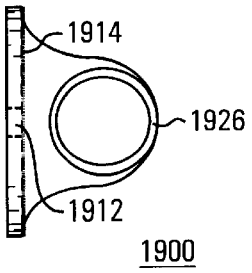
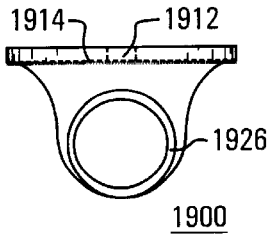
FIG. 19E
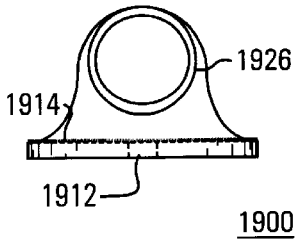
FIG. 19C
FIG. 19B
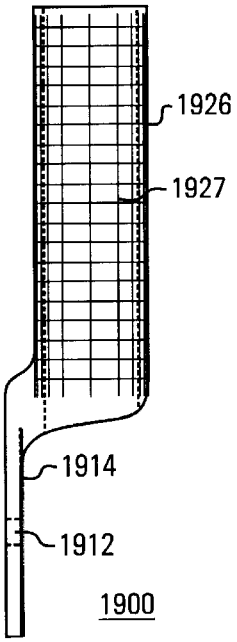
FIG. 19F
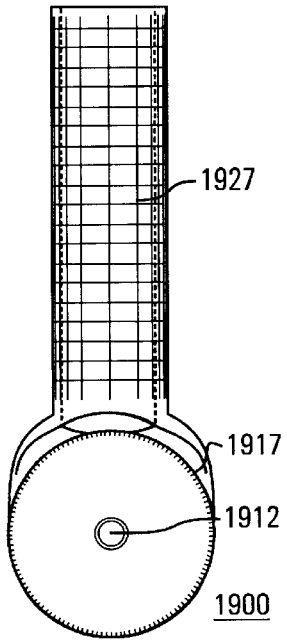
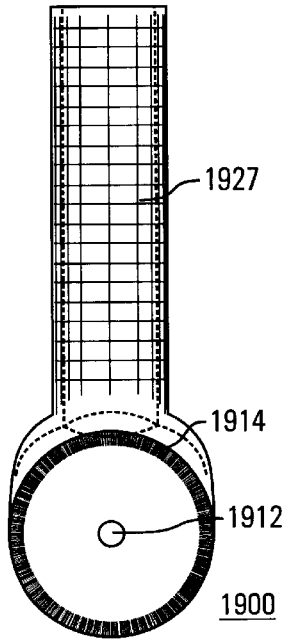
FIG. 19D

STABILIZED GOLF CLUB

BACKGROUND OF THE INVENTION

1. Field of the Invention

The present invention relates generally to the field of athletic devices and more particularly to a device for efficiently transferring kinetic energy from a club to a ball.

2. Description of Related Art

The purpose of many sports related devices is merely to effect a transfer energy from a player to a target object. The games of baseball, tennis, badminton, racket ball, hockey, lacrosse, ping pong and others, all require a participant to transmit human generated energy to a target, at one time or another, in order to compete in the game. Generally, a specialized stick is employed by the contestant for the purpose of converting bio-kinetic energy to kinetic energy or at least redirect the bio-kinetic energy. A more efficiently designed stick transfers a greater percentage of the bio-kinetic energy to the target object than a lesser efficient stick. Sport's equipment is often designed to achieve this goal.

BRIEF SUMMARY OF THE INVENTION

The present invention relates to golf clubs, more particularly to a stabilized golf club that accounts for human factors in its design and configuration. In accordance with one embodiment a "berish bracket" is attached to two points on a club head for increased controllability. The shaft attaches to the berish and provides the force necessary to propel the ball forward but, due to the configuration of the berish bracket, the forces is applied at least two points along the club head. In accordance with another embodiment, the club shaft is configured to point forward of the moment of mass of the club head, thereby further increasing controllability. In accordance with other embodiments, a configurable knuckle is configured between the club shaft and the berish bracket for optimizing controllability for an individual golfer. In addition to optimizing controllability, the configurable knuckle provides for six-degrees-adjustability thereby allowing a club to be reconfigured to handle and feel similar to other clubs by articulating adjustments on the knuckle to predetermined adjustment settings.

BRIEF DESCRIPTION OF THE DRAWINGS

The novel features believed characteristic of the invention are set forth in the appended claims. The invention itself, however, as well as an exemplary mode of use, further objectives and advantages thereof, will best be understood by reference to the following detailed description of an illustrative embodiment when read in conjunction with the accompanying drawings, wherein:

The present invention is illustrated by way of example, and not by way of limitation, in the figures of the accompanying drawings and in which like reference numerals indicate similar elements and in which:

FIG. 9 is a diagram exemplary rear facing view depicting a perimeter weighted club head;

FIGS. 10A–10C are diagrams of club configurations including representative control envelopes;

FIGS. 19A–19F depict a combination adjustment part in accordance with an exemplary embodiment of the present invention, FIG. 19B illustrates a lateral side view, FIG. 19D illustrates a rear side view and FIG. 19F illustrates a front side view, and FIGS. 19A, 19C and 19E illustrate plan views of the respective side views;

Other features of the present invention will be apparent from the accompanying drawings and from the detailed description which follows.

DETAILED DESCRIPTION OF THE INVENTION

For clarity, the figure drawing will be described using corresponding element numbers throughout. For instance, golf ball will be referred to as ball X02, the club head as club or putter X04 and the shaft as shaft X06 wherein "X" corresponds to the figure number. In addition, the character "M" denotes the moment attribute of an element and a subscript, such as "$_b$", "$_p$" or "$_s$" denotes the element associated with the particular attribute, ball, putter and shaft, respectively.

Figure 1A:
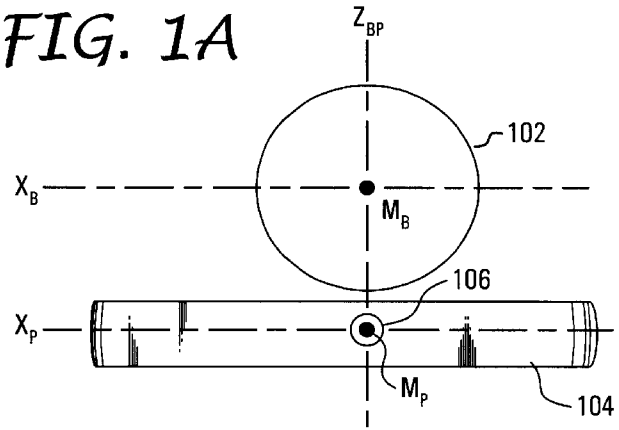
FIGS. 1A–1C are diagrams of views depicting the alignment of an exemplary putter head and golf ball.
Figure 1C:
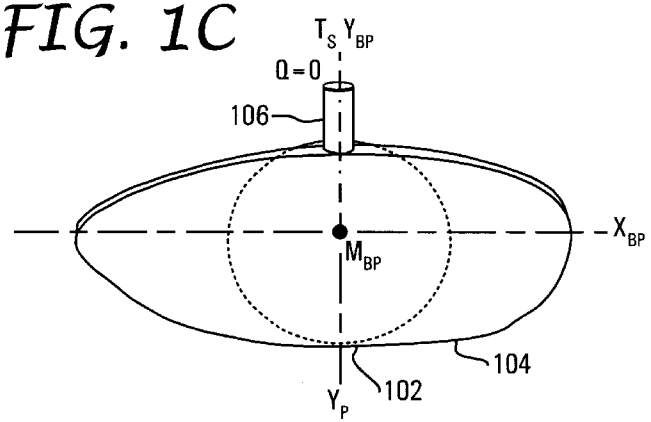
Figure 1B:
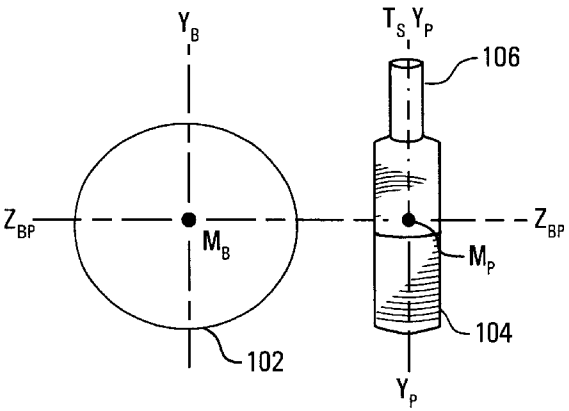

With respect to FIGS. 1A–1C exemplary views of the alignment of a common putter head, head 104 and golf ball, ball 102 are depicted in plan view (FIG. 1A), side view (FIG. 1B) and rear view (FIG. 1C). Associated with ball 102 are a particular set of attributes, i.e. shape, resiliency (stiffness), component material(s), mass and moment of mass. Stability, with respect to stationary objects such as golf balls and sports equipment, is inexorably linked to the moment of mass for the object. Ball 102, has a center of mass, $M_b$, also called the centroid, moment of mass or center of gravity and will be referred to alternatively throughout. One of ordinary skill of the art would understand the moment of mass to be the point of a body at which the force of gravity can be considered to act and which undergoes no internal motion For a discrete distribution of masses $m_i$ located at positions $r_i$, the position of the center of mass $M_{cntr}$ is given as:

$$M_{cntr} \equiv \frac{\sum_i m_i r_1}{\sum_i m_i} \equiv \frac{\sum_i m_i r_1}{M_{mass}} \tag{1}$$

Where $$M_{mass} \equiv \sum_i m_i$$

Notice from equation (1) that $M_{cntr}$ is determined by the sum of all masses that comprise the object. In the case of golf ball 102, the masses $m_i$ are comprised of concentric spheres of materials, i.e. core (inner and outer are possible), elastic or rubber thread wrapped layer (again, one or more thread types may be wound, one on another) and cover (possibly comprised of a stronger inner cover and puncture resistant outer cover).

FIGS. 1A–1C also depict head 104 as having a club moment, $M_p$, which is calculated in exactly the same manner as was described for ball 102, however, head 104 has a much more complex shape than ball 102, making the calculation of $M_p$ equally complex. Often, the moment of mass for objects (object moment) having complex three-dimensional shapes is computed by finding the position of M for each axis, one plane at a time. After which the three positions are combined and (X,Y,Z) triplet is returned defining a three-dimensional position, M, on the object. A mass moment of any club head can be determined in a similar manner as mass moment $M_p$ for head 104. Often objects are modeled as "point" objects for calculating their responses and interactions to static and dynamic forces applied to them (a point object is an object having a mass but no volume).

Also depicted in FIGS. 1A–1C are local coordinate systems for ball 102 and putter 104 shown as axis $X_b$, $Y_b$ and $Z_b$ and $X_p$, $Y_p$ and $Z_p$ respectively. The origin of each local coordinate system is centered at the moment of mass M of the local object, thus ball moment $M_b$ is the origin of the $X_b$ $Y_b$ $Z_b$ local coordinated system for ball 102 and head moment $M_b$ is the origin of the $X_p$ $Y_p$ $Z_p$ local coordinated system for head 104. This notation is common when using point objects calculations. Mass moment defined local coordinate systems can be exceptionally useful for point object calculations and may provide the reader with a naive view of the positional relationship of head 104 and ball 102. However, other coordinate system definitions may also be helpful for understanding or simplifying object interaction computations, especially for complex object shapes. For instance, rather than using the moment of mass for each local object as the local origin, the origin can be specified at other critical locations on the object, such as the contact point on the surface of the object where the objects come in contact with one another. Translating the coordinate origin to the contact point normally simplifies movement calculation due to forces that are internal and external to the object. Often it is easier to translate internal force values (usually defined by vectors or matrices) for colliding objects to a single collision point for both objects and then determine the objects' paths rather than using two separate points, i.e. the individual mass moments of the objects.

Regardless of the definition of the origins, standard Cartesian coordinate systems are used herein. For clarity the Y axis is defined as the intersection of plane X and Z planes, the X axis is defined as the intersection of plane Z and Y planes and the Z axis is defined as the intersection of plane Y and X planes. With respect to the description of the present invention, axes Y and Z define a plane that is substantially parallel to horizontal, thus the Y-Z plane may be the putting green and the Z axis travels along that plane. Axes Z and Y define a plane that is substantially parallel to vertical and oriented between the ball and putter, thus plane Z-Y plane may define the path of a club swing or the path of ball 102 after contact by head 104. Finally, axes X and Z also define a plane that is substantially parallel to vertical but oriented at right angle to the Z-Y plane, thus the X-Z plane may subtend the golfer and ball, or the golfer and club. It should be understood that local coordinate systems $X_b$ $Y_b$ $Z_b$ and $X_p$ $Y_p$ $Z_p$ are intended as static coordinates and not used, for the purposes herein, for the dynamically calculating either swing motion or ball path.

Notice also from FIGS. 1A–1C that from certain viewpoints that head moment $M_p$ and ball moment $M_b$ are aligned. For instance $M_p$ and $M_b$ are coincidental in FIG. 1C and therefore are denoted as $M_{bp}$. Similarly, axes $Z_b$ and $Z_p$ are coincidental in FIGS. 1A and 1B and therefore are denoted as $Z_{bp}$ in those views. Also, local axes $Y_b$ and $Y_p$ are coincidental when viewed from the rear, as in FIG. 1C but not from the side, as depicted in FIG. 1B and therefore local axes $Y_b$ and $Y_p$ are denoted as $Z_{bp}$ in FIG. 1C but not in FIG. 1B. A thorough understanding of physics and/or geometry is not essential for practicing all aspects of the invention, but a basic understanding may be helpful with some concepts described below with respect to the drawings.

Turning now to the putter depicted in FIGS. 1A–1C, notice that this particular type of club resembles a mallet with shaft 106 protruding from the approximate center of putter 104 directly above head moment $M_p$. Notice also that in this representation that shaft 106 is coincidental with axes $Y_{bp}$ thereby forming a shaft torque angle θ of zero degrees to the Y axis, which coincidentally rotates around the Z axis in the Z-X plane. Thus, shaft 106 is approximately vertical, or perpendicular to the horizontal plane (the green of a golf course for instance). This type of club requires a golfer to lean over the ball position and grip shaft 106 directly over ball 102 in order to swing the club coincidental with the $Z_{bp}$ axes in the $Z_{bp}$-$Y_b$ or $Y_p$ planes. Such a mallet-type putter is commonly preferred by novices and similar club configurations are often found at miniature golfing establishments. The mallet-type configuration shown in the figures is extremely stable and controllable, so much so that this design configuration is preferred for sports like equestrian and bicycle polo in which the user is constantly in motion, complicating grip, positioning, aim and follow-through on the ball.

Recall that the purpose of any club is to transmit or convert a golfer's bio-kinetic energy to the golf ball Optimizing the transfer and/or conversion of bio-kinetic energy is an ongoing challenge for any manufacturer interested in competing in the lucrative golf club industry. Much research is devoted to finding the most optimal design and material composites for increasing the transfer efficiency. By using the procedures outlined above, a manufacturer's design team can often create representative models of new and innovative club configurations and calculate their responses prior to building and testing a prototype club. Less efficient club designs are rejected while more promising designs are prototyped and tested. The testing of new club designs is rigorous. Banks of swing machines (swinging robots) are employed for evaluating promising club designs by applying a range of swing speeds through a variety of temperature and moisture conditions. The results of the testing, hopefully, confirm the club design. Generally, club efficiency, and thus the club design, is rated by the distance a ball travels (range) and the grouping pattern of balls hit by comparable swing speeds (consistency, sometimes confused with accuracy). The transmission of energy from a first object having a first mass $m_1$ moving at a velocity of $v_{1i}$ colliding with a second object having a second mass $m_2$ moving at a velocity of $v_{2i}$ in a completely inelastic collision may be estimated by the following equation:

$$m_1v_{1i}+m_2v_{2i}=m_1v_{1f}+m_2v_{2f} \quad (2)$$

As a result of the collision the first object attains a velocity of $v_1$, while the second object attains a second velocity of $v_{2f}$. With respect to a resting object the equation becomes:

$$m_1v_{1i}=m_1v_{1f}+m_2v_{2f} \quad (3)$$

In practice, a swing machine repeatedly hits golf balls onto a test range. The range each ball travels is plotted. Actual range results for balls always differ from the expected range results calculated from design models because certain real world factors are difficult to approximate. A normal distribution of the frequency density of range per hit data could be expected to be symmetric and therefore has a skewness value of zero (a typical "bell" curve, both sides of the maximum value being symmetric). In a normal distribution pattern, 68% of the datum points fall within +/− one standard deviation of the mean, and 95% of the data fall within +/− two standard deviations. However, the frequency density of the range per hit data is not a symmetrical normal distribution but instead is distorted or skewed. Machine generated range data per hit typically generates a frequency distribution with a significant positive skewness and has a right tail (not shown). The frequency distribution always plots to the right (less than) the range results expected from the design model (if perfect club efficiency and consistency data could be achieved, the frequency plot would overlay the expected range results). The more skewness in a distribution, the more variability in the range per hit scores, thus the longer the right tail and the relative consistency for the club design and configuration is correspondingly lower. Furthermore, the wider the variation in distance, $\Delta D_{sd}$, for a standard deviation also indicates a lower relative consistency score for the particular club design and configuration. The magnitude of skew is an indicator of relative consistency. The ordinary artisan will appreciate that the positional differences between the mean, median and mode can be used to create measures of skewness and therefore can be used as a measure of relative consistency. Of the several skew metrics that exist, one of the most useful is Pearson's coefficient of skewness, which is a measure of skewness that focuses on the difference between the mode and the mean, and then relates the difference to the standard deviation.

The club speed or velocity at head 104 is attained by the machine applying a rotational force at the distal end of shaft 106 such that torque arm $T_s$ is created between the machine and club head 104 Torque arm $T_s$ is depicted in the figures as a broken line. Rarely, if ever, does a swing machine buy a golf club, so most manufacturers perform at least limited testing using live subjects to determine how golfers react to the design. The results the human subject testing is again confirmed by ranking the club design by range and consistency. The results from human subject tests never equal machine results because of "human factors" that can not be replicated in the swing machine. Human factors directly influence the "control" of energy transmitted from the human subject through the club to the ball. Human factors encompass all aspects of the man-machine interface that lower the results, for example grip, body position, stance, follow-through, etc. While it might be possible to determine which human factors have the most effect on a golf stroke, and thereby have the most detrimental affect on efficiency, human factors are extremely difficult to quantify and likewise difficult to model mathematically. The degree to which any of these factors influence the transmission of bio-kinetic energy to a golf ball varies with the individual. However, it would seems that similar results could be expected from groups of individuals with similar attribute (skill level, strength, height, weight, etc.), making limited human factor modeling more possible. Verification of human factor models has been, thus far, less than adequate Mathematical models that include both physical club attributes and human factors have not substantially increased the manufacturers' capacity for identifying user acceptance of new club designs. Even though the modeling, design and testing processes are important for a club manufacturer, ultimately the club users decide whether or not the club configuration is a success. It seems clear that control is more of a factor for users, at least novice to intermediate level users, than the combination of range and consistency strived for by manufactures.

Control might be defined as rating range and consistency with respect to human factors. While equation (3) above is an acceptable estimation of some types of object collisions, equation (3) does not accurately describe real world collisions. With regard to the description herein, it is understood that range and consistency are reduced whenever the face of head 104 is not "square" or exactly perpendicular with axis $Z_{bp}$ i.e., across a line on the ground in a direction normal to the club head at the moment of impact For maximum efficiency the face of the club must be square and not "open" or "closed." Holding the face of head 104 open subjects the path of ball 102 to a hook and, conversely, holding the face closed subjects the path of ball 102 to a slice. The face of the club is referred to being "open" when it is turned clockwise by a right handed golfer at the moment of impact as the player swings the club. A "closed" face occurs when the face of the club is turned counterclockwise by a right handed golfer as the player strokes the ball. When the face of the club head is "open", the ball will hook when the player makes contact with the ball and a "closed" face will result in the ball being sliced when the club head makes contact with the ball. The club head cuts across the other side of that line relative to the golfer to the near side of the line. Further, normally A golfer lines up a shot to the cup. In the figures, an accurate line up is represented as the axis $Z_{bp}$ intercepting both ball 102 and head 104 but not represented in the figures, $Z_{bp}$ must also intercept cup. The present invention does little to compensate for a user's choice of line, nor does the present invention compensate for an "open" or "closed" grip prior to head 104 striking ball 102. The exemplary embodiments of the present invention are, instead, directed to accommodating human factor affects and thereby increasing controllability of a club. The principle of "control" used herein, concedes that collisions occur in three-dimensional space and result in three-dimensional trajectories. However, for the purposes herein it is assumed that the horizontal plane of the ground is unbroken and loft is approximately equal to zero unless otherwise indicated. Thus, equation (3) becomes:

$$m_1v_{1i}=m_1v_{1f}\cos\lambda_1+m_2v_{2f}\cos\lambda_2 \tag{4}$$

for the Z component, and:

$$0=m_2v_{2f}\sin\lambda_2-m_1v_{1f}\sin\lambda_1 \tag{5}$$

for the X component.

Control is sometimes mistakenly referred to as the "sweet spot" on the club head's face or making contact with a golf ball in that interval. The larger the sweet spot, manufacturers have analogized, the more control a golfer has on the outcome of a swing and collision with a ball. However, in the case of many club designs, the area of the sweet spot can be increased but performance (efficiency) is reduced proportionally. Thus, highly stable, well-behaved clubs with optimal control are often relegated to novices because they do not efficiently convert bio-kinetic energy into distance or range. However, as alluded to above, even though rudimentary human factor models might suggest that a particular club design would tend to "fit" a particular group of users, often the pragmatic results do not support the model. Optimally, designing a club for both efficiency and controllability seem to be more individual than the design science would indicate.

FIGS. 1–10 depict various well-known club designs and corresponding, empirically derived control data associated with each club design. Turning now to FIGS. 2A–2C, the mallet type club described above in FIGS. 1A–1C is shown accompanied with empirical control indicators represented as arrows extending from the face of head 204. Head configurations depicted in FIGS. 2A–2C differ only in the position in which shaft 206 connected to head 204. FIG. 2A representing the configuration shown in FIG. 1 above with shaft 206 protruding from the approximate center of head 204 and intersecting $M_p$. In this representation the closest distance, $d_{Tp}$, between torque arm $T_s$ and the moment for head 204, $M_p$ is equal to zero as torque arm $T_s$ intersects $M_p$. The shaft 206 is coincidental with axes $Y_{bp}$ forming a shaft torque angle θ of zero degrees to the Y axis in the Z-X planes, thus shaft 206 is approximately vertical and perpendicular to the horizontal plane (the green for instance). That is the putter torque arm for the force applied to putter 204, represented in FIG. 2B as $T_p$. Notice that the length of distance putter torque arm $T_p$ is $d_{Tp}$ represented in each of FIGS. 2A–2C, wherein $d_{Tp}=0$ in FIG. 2A because shaft torque arm $T_s$ directly intersects head moment $M_p$ for head 204, $M_p$. Distance putter torque arm $d_{Tp}$ becomes correspondingly larger as the position of shaft 206 is affixed to head 204 at points increasingly remote from the position of head moment $M_p$, depicting in FIGS. 2B and 2C.

Figure 2C:
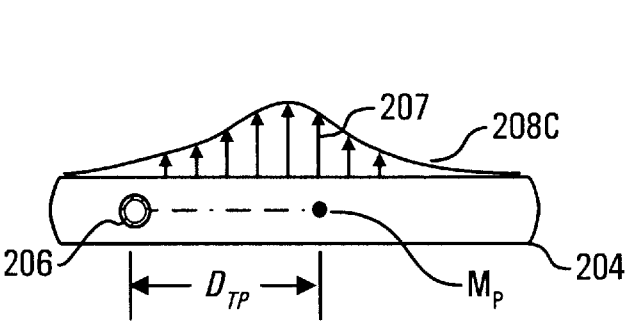
FIGS. 2A–2C are diagrams of a mallet type club design with empirical control indicators superimposed from the face of the head.
Figure 2B:
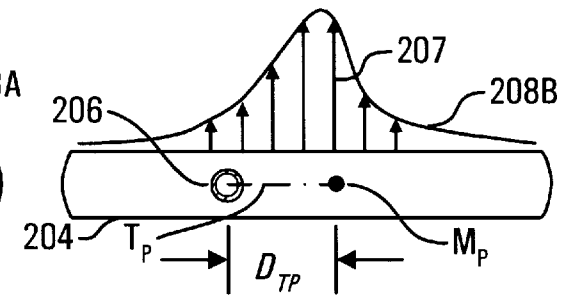
Figure 2A:
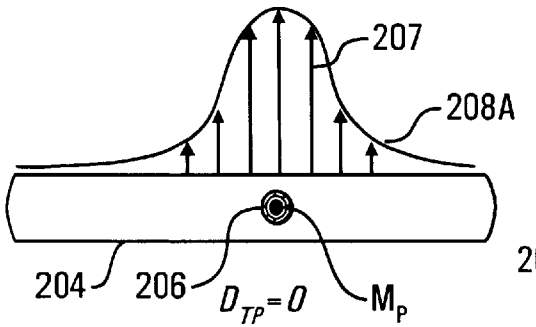

Associated with each head configuration depicted in FIGS. 2A–2C is a set of control vectors 207 that represent empirically derived control data for the particular head configuration. Notice also that each set of control vectors define a control envelope for the head, envelope 208A corresponds to the head configuration shown in FIG. 2A, envelope 208B corresponds to the head configuration shown in FIG. 2B and envelope 208C corresponds to the head configuration shown in FIG. 2C.

Each of control vectors 207 is a measure of empirically derived data that represents an average approximation of efficiency, consistency and predictability of the transfer of bio-kinetic energy from a group of users to a ball. Efficiency and consistency have been discussed above and relate generally to the distance a ball travels as a result of an amount of kinetic energy (swing speed) and the reproducibility of the results. Predictability has thus far not been discussed but within the context of control vectors 207, predictability is a measure of the correspondence between the club angle and the path of the ball after being struck. For instance, from equations (4) and (5) above it can be proven that the reflection angle can be predicted as the angle of incidence, whenever a rigid object strikes another rigid object having infinitely greater mass (immovable). A light beam reflects off a mirror at the same angle as it intersects the mirror. When a golfer holds a club at an angle, a ball struck by the club should follow a path related to the angle of the club. However, the golf ball does not always travel in the path anticipated by the club angle. If the club rotates in the golfer's grip, even slightly, then the actual path varies from the anticipated or predicted path. For example, if a golfer is six feet from the cup and hits the ball toward the center of the cup while holding the club square, the ball will miss the cup completely if the club rotates by more than 1.79°. At ten feet from the cup the amount of rotation is reduced to 1.09° and at fifteen feet the permissible rotation is less than 0.72°. For a four inch long putter configured as shown in FIGS. 1A and 2A, the heal and toe of head 204 would move only about 0.025, less than three-hundredths of an inch. Predictability is not, to any large degree, related to the club angle, so whether head 204 is square, open or closed, the predictability parameter is gauged by the expected path of the ball.

Empirical data that can be converted to representations of control vectors 207 may be gathered from human subjects using several methods but must include at least club head speed prior to contacting the ball, the orientation of the club head face with respect to the Z axis, the contact point on the club face and the final position of the ball after the ball's kinetic energy is spent and the ball comes to rest. The inquiry required for accurately approximating efficiency, consistency and predictability is much more rigorous than merely determining a club's performance efficiency and consistency.

As a practical matter, acquiring the control data requires that the human subjects be monitored while hitting golf balls using highly accurate measuring equipment, especially for determining the orientation of the club head face and its speed just prior to contacting the ball. With respect to one exemplary data acquisition process, a target is attracted to the club's shaft proximate and perpendicular to the face. The target is first scanned by a laser scanner with the club's face perpendicular to the Z axis and sends the results to a data processing system. The data processing system computes the measurements of the target from the scanned data. Those measurements are stored as the reference measurements of the target. Then, whenever a subject swings the club, the laser scanner again scans the target and passes the new data to the data processing system which computes and compares the new area data to the reference measurements for the target. From the comparison of the new measurements to the reference measurements, the data processing system uses a trigonometric algorithm to compute the orientation of the club's face just prior to striking the ball. The shaft speed can also be determined using a laser by applying a Doppler-base velocity determination algorithm to the laser data. It's expected that a second laser beam is used for the speed measurement. The laser(s) can be aimed from any angle but must take the measurements just prior to the club head's face impacting the ball. A triggering beam may be required for triggering laser readings at the precise club head position necessary for the most accurate measurement. A particularly useful approach is to designate the target with the laser scanner positioned forward of the ball on the Z axis. In that position simultaneous measurements for the club head speed, face orientation and the ball contact point on the club's face can be gathered with the single laser scanner, given the proper algorithms. Other devices exist for determining club head speed, face orientation and the ball contact point, though these devices are more manually intensive. These include digital imaging. A club head's orientation can be approximated by up-taking an image of a specialized target that appears differently when viewed from different orientations. That target, while known in certain arts, is a three-dimensional composite of parallel lines etched into a substrate. The adjacent parallel lines have graduated widths from one side of the target to the other. As the target is reoriented from perpendicular with the digital imager, the narrower lines blend together. The target's orientation is determined by comparing the demarcation point between distinguishable adjacent parallel lines and lines that are not distinguishable from each other. In addition to acquiring face orientation information, the precise contact point of the ball on the face of the club head is easily deciphered from a digital image as well as the speed of the club head just prior to contact with the ball. Club head speed can be resolved from a single image or several images taken in rapid succession. Speed is determined from a digital image by the distance traversed by the club head during a predetermined time interval. The time interval is a function of frame acquisition time, in the case of measuring club movement on a single image frame, or frame speed where club movement is taken from several sequential image frames. Again, the image must be taken just prior to the club face making contact with the ball.

Regardless of the specific means for acquiring club head speed, face orientation and the ball contact point, position information that defines the actual position of the ball after coming to rest on the surface of the range must also be acquired. Position data is taken from the location where the ball comes to rest on the test range (distance D or range). The test range is subdivided into equally spaced concentric range (distance) circles that are, in turn, subdivided by equally offset radii which extend from the location of the tee on the range. The concentric circles and radii form a polar coordinate system with its origin set at the original position of the ball, at the tee. The position information for the actual distance, $D_a$, can be read off the test range in polar form (as a range and azimuth tuplet).

The control metric may be simply defined as the ratio of the actual results to the executed results. Whenever the actual results match the expected results, then control is maximized. Recall that swinging machines eliminate any possible human factors component while measuring club efficiency by eliminating human participation. The acquisition of club efficiency data, stated as the range and consistency, is maximized for a discrete head speed by using a machine and thus control is similarly maximized because the human factors components are eliminated from the computation. Therefore, the maximum range value for a discrete club head speed, $D_m$, could be predicted from the machine range data, $D_m$, $\approx D_p$, again certain real world conditions are too difficult to model so the maximum machine range, $D_m$, is rarely equivalent to the predicted range, $D_p$, from the design model. Therefore, a value for $D_p$ might also be attained by accurately modeling the club head configuration as also discussed above. Regardless of the source for the predicted distance of an impact resulting from a discrete club speed $D_p$, the actual distance, $D_a$, will relate to the predicted range $D_p$ by a function of the human factors components, the control. However, the predicted rest position of the ball is specified by range, $D_p$, and angular, $\lambda_p$, components because unlike the swinging machine, human subjects are prone to poorly aimed shots that result in more off axis ball positions.

The range and angle data for the actual position of a resting ball ($D_a$, $\lambda_a$) is fed into the data processing system which compares the actual position data to the predicted range and angle ($D_p$, $\lambda_p$) for the stroke's club head speed and face orientation. The above described method is designed to negate the disparity of skill levels between individual human subjects while accurately measuring a normalized value for the control metric of various club designs and configurations. The proximity of a ball position to the target image is related more to skill level of the subject than the club controllability. Expert golfers have a better sense of calibrating both their swing speed and club face orientation to a target and thus are more able to hit a target image than golfers having lesser skill levels. Therefore, the position of the ball relative to the target cup should be discounted. The skill level of individual subjects is a non-factor when determining a control value because the data processing system predicts the ball's final position from the club head speed and the face orientation. The processing system does not use the position of the target cup in the computation of the predicted ball position. Therefore, even though the subjects are instructed to aim for a target image of a cup, the ball's proximity to the target image is not considered when computing a control value. In practice, subjects are encouraged to vary their stances and swing speed by electronically repositioning the target image on the range.

A control value is generated for each shot taken by a subject and categorized by respective contact points on the club head's face. Again the control metric is the ratio of the actual results to the executed results. This ratio of actual range to expected range produces a normalized control data value. Below is an exemplary approximation for determining a control value.

$$\text{control data value} = \frac{D_a \cos(\lambda_p - \lambda_a)}{D_p} \tag{6}$$

where $D_a$ is the actual distance from the tee;

$D_p$ is the predicted distance from the tee;

$\lambda_a$ is the actual azimuth; and $\lambda_a$ is the predicted azimuth.

A control data value is generated for each hit taken by a human subject. A predetermined sample set of human subjects are employed for acquiring the data used to generate the control data values. Each subject has a particular skill level and the sample set includes representative levels for all possible skill levels. After a predetermined number control data values have been accumulated, the control data values for each position on the club head's face are plotted, similar to that described above with respect to determining consistence. Here though, the standard deviation is intended as a measure of repeatability and not consistency. The standard statistical functions were employed that were described above, however, the frequency distribution pattern for the control data values tends not to fit any of the distribution patterns discussed above.

From the machine range per hit frequency distribution results, it was expected that the control data value per hit frequency distribution results would also exhibit a single peak and have significant positive skewness. Such was not the case. Instead, for contact positions with higher control data values per hit frequency distribution plot has positive skewness but the plot also exhibited a double peak. The primary peak is essentially in the predicted position on the plot but the secondary peak appears near the first standard deviation. Furthermore, contact positions with lower control data values per hit frequency distribution plot have positive skewness and the plot also exhibited triple peaks. Again, the primary peak is essentially in the predicted position on the plot and a secondary peak occurs near the first standard deviation, albeit slightly to the right of its occurrence in higher control data value plots. The tertiary peak occurs to the left of the primary peak, thus that peak is indicative of more control. The peaks were compared to the relative skill levels of the subjects, but there was no positive correlation between peak formation and skill level. Initially, it was postulated that the tertiary peak was formed entirely from control data values of subjects having a higher skill level and the secondary peak was formed entirely from control data values of subjects having a lower skill level. The data did not support that assumption. Instead, control data values for all skill levels were comparatively consistently distributed between the peaks. The results of those findings, unbeknownst to the researchers, supported well known anecdotal evidence in the golfing industry that an individual player seems to have an innate aptitude for particular club head designs and configurations. It follows then that even the most efficiently designed and configured club may be less controllable for a golfer than a lesser efficient club due to the man-machine interface and the human factors related to that interface.

Returning now to the process for generating control data vectors from the control datum values, a representative statistical function for repeatability, mean, median and mode, is applied to the control data value per hit frequency distribution plot that estimates the repeatability at that contact point. A control vector is the product of the application of the statistical function, such as control vectors 207 depicted in FIGS. 2A–2C. Finally, the control vectors may be normalized across the face of the club head with standardized control data applicable to all club designs and configuration tested, although this step is optional.

In an example of the above described process for determining control data value vectors for a specific club design and configuration, data representing club head speed, face orientation and the ball contact point are acquired and fed into the data processing system. The data processing system then predicts where the ball should come to rest, distance and angle, ($D_p$, $\lambda_p$), from the tee using the speed and face orientation information. If the ball actually stops at the predicted range and angle, then the control value of the stroke is the maximum, a control data value of 1.00. If the ball's actual position, ($D_a$, $\lambda_a$), falls short of the predicted range, but stays on the predicted azimuth ($D_p \neq D_a$, and $\lambda_p \approx \lambda_p$), then the control data value is reduced proportionally to the reduction in linear distance. Accordingly, if the ball actually stops nine and one half foot from the tee and ten feet was predicted from the club speed, the control value would be reduced to 0.95. However, if a ball comes to rest off of the predicted azimuth vector from the tee, ($\lambda_p \neq \lambda_p$), the range ratio value is reduced by a sinusoidal function. If, for example, the predicted position of the ball was 10, 22°) but actual resting position of the ball is (9.5, 34°), the control data value for the particular club design and configuration at the ball contact point on the club head face is 0.929.

From the description above, it is clear that the magnitude control vector 207 depends on the range (distance) and the repeatability and predictability of distance results at a point on the face of head 204. Higher scoring areas on a club head's face are points where bio-kinetic energy is more efficiently transferred to the ball and that energy transfer is predictably repeatable (controlled). Those points are represented with control vectors 207 having corresponding higher magnitudes than points with lesser magnitude control data vectors. The outer bound of control vectors 207 form envelope 208A that represents the skill level normalized empirically derived control data values across the striking face for a club designed and configured as depicted in FIG. 2A. From envelope 208A, it is apparent that the best control results can be expected from head 204, configured as shown in FIG. 2A, by making contact with a golf ball at the point on the face of head 204 closest to $M_p$, or coaxial with the Z axis (shown on FIG. 1A). That means that for a group of human subjects (skill levels ranging from novice to expert), the best chance of attaining the longest, straightest putt is by contacting the ball at the Z axis on the face of head 204. As the contact point moves along the face of head 204 to either side of the Z axis, the magnitude of control vectors 207 is reduced thereby signifying a loss of control from the contact of the ball at the Z axis. At some point along the face of head 204 to either side of the Z axis, the magnitude of control vectors 207 drops to a level such that control is almost completely lost.

Recall, control is defined herein as the cumulative product of efficiency, consistency and predictability. While the resultant putting distances for an individual golfer may not vary significantly for the contact points across the face of head 204, the magnitude of the putting distances might differ from one golfer to another. Therefore, for an individual golfer, the magnitude of the control vector may be reduced by poor range, lack of repeatable range and unpredictability of the balls' path. Envelope 208 is derived from a plurality of control vectors 207 across the face of head 204 empirically represents both the predictable physical club attributes and the unpredictable human factors by rating predictions of range and consistency for human subject golfers. Envelope 208 predicts the relative control results for any individual subject or group of subjects by predicting control results for all club users.

Comparing FIGS. 2A–2C, it is apparent from the shape of corresponding control envelopes 208A–208C that control varies inversely with $d_{Tp}$, as the point where shaft 206 attaches to head 204 from head moment $M_p$ (the length of putter torque arm). Therefore, for head 204 attached to shaft 206 and having a shaft torque angle θ of zero degrees to the Y axis, maximum control is expected where $d_{Tp}=0$, thus where the club is configured as shown in FIG. 2A. These results could be predicted because, in partial accordance with equations (4) and (5) above, both shaft torque $T_s$ and $M_p$ are aligned with each other and both are aligned with the ball along axis $Z_{bp}$. Also notice by comparing envelopes 208A through 208C that as the length of putter torque arm $d_{Tp}$ increases, the area of maximum control moves from directly adjacent to $M_p$ toward the point where shaft 206 attaches to head 204. This is somewhat less predictable from the machine data but is essentially due to shaft torque $T_s$ being applied at a point on head 204 that is out of alignment with $M_p$ or $M_b$ and off of axis $Z_{bp}$.

Figure 3:
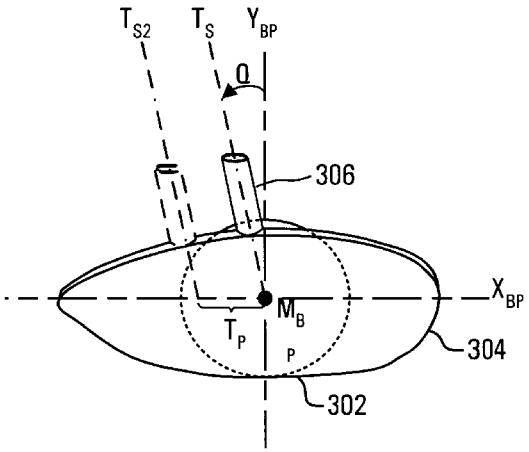
FIG. 3 is a pictorial representation of a head design of a putter further showing a putter shaft connected to the head thereby creating shaft torque angle to the Y axis.

FIG. 3 is a pictorial representation of a head design that is similar to that shown in FIGS. 1A–1C, however FIG. 3 shows shaft 306 forming a shaft torque angle θ that is greater than zero degrees to the Y axis, taken around the Z axis. Club designers normally tilt shaft 306 in order to allow the golfer to stand more to the side of ball 302, rather than almost directly over it. This position is more natural for a golfer and much more comfortable. A golfer's position is important because it allows the golfer to get a vantage point to aim for a target, the cup for instance. Increasing angle θ gives the golfer a better vantage point to view the lie of ball 302 with respect to a target.

Figure 4A:
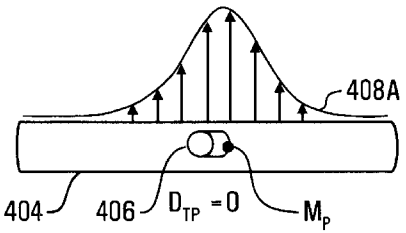
FIGS. 4A–4C are pictorial representations of a head design shown in a variety of club configurations with the control vectors associated with those club configurations.
Figure 4B:
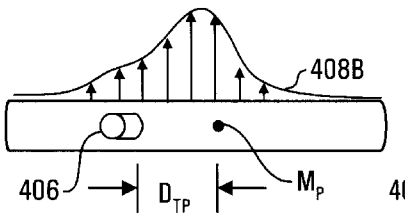
Figure 4C:
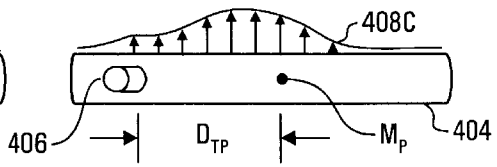

FIGS. 4A–4C are pictorial representations of the head design shown in FIG. 3, in a variety of configurations with the control vectors associated with those configurations. By comparing FIGS. 4A–4C an apparent relationship exists between the shape of respective control envelopes 408A–408C and the length of putter torque arm $d_{Tp}$, similar to that discussed above with respect to FIGS. 2A–2C. Here again, control envelopes 408A–408C illustrate that as the length of putter torque arm $d_{Tp}$ increases, the maximum amount of control decreases. However, while absolute value of control decreases, control is more evenly distributed over the face of head 404, probably due to the separation of $T_s$ and $M_p$ by a distance equal to $d_{Tp}$. Notice also that the shape of control envelope 408B is more linear than the shape of control envelope 408A and the shape of control envelope 408C is smoother and more linear than either of control envelope 408A or 408B. Therefore, even though the absolute magnitude of the control vectors for the putter configuration shown in FIG. 4C is less than for either club configuration shown in FIG. 4B or 4A, an amount of control exists across a greater portion of face of head 404.

It should be noted that by comparing envelopes 208A–C from FIGS. 2A–2C with envelopes 408A–C, the club configurations depicted in FIGS. 2A–2C exhibit more control that those shown in FIGS. 4A–4C. However, the club configurations depicted in FIGS. 2A–2C are not popular with golfers. This is so because the club configurations shown in FIGS. 4A–4C allow the golfer to get a better perspective of the ball and target, and therefore a more accurate read on the shot. Overall accuracy is improved with the club configurations shown in FIGS. 4A–4C even though control is somewhat diminished from the respective configurations depicted in FIGS. 2A–2C.

Figure 5A:
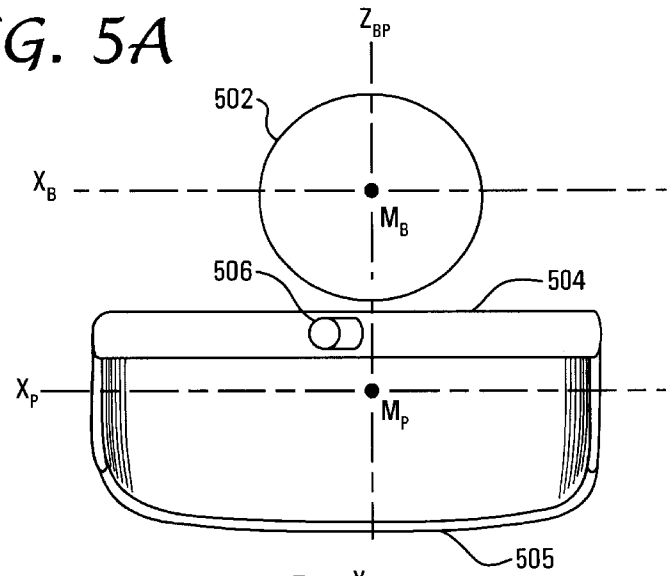
FIGS. 5A–5C are diagrams of views depicting the alignment of a exemplary putter head and golf ball.
Figure 5C:
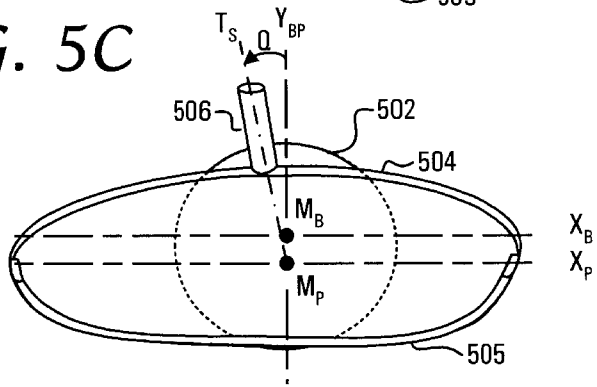
Figure 5B:
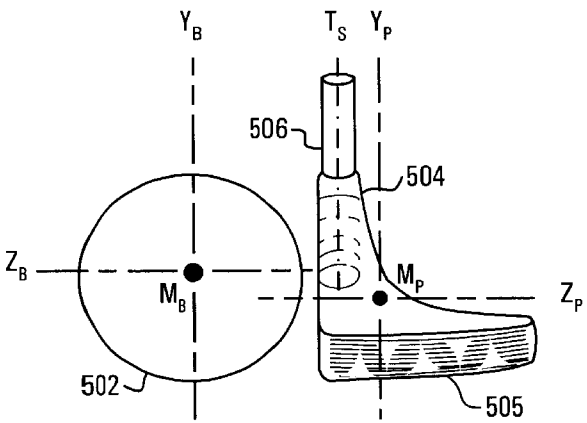

With respect to FIGS. 5A–5C, exemplary views of the alignment of a common putter head, head 504 and golf ball, ball 502 are depicted in plan view (FIG. 5A), side view (FIG. 5B) and rear facing view (FIG. 5C). Shaft 506 attaches to head 504 forming a shaft torque angle θ with the Y axis. Also notice that shoe 505 forms the lower portion of head 504. Shoe 505 is designed to give head 504 more mass and further to provide a golfer with an alternative to using a chipping wedge for lies near the green but still in the rough. Head 504 design with shoe 505 moves through longer turf than conventional putter designs with a narrower shoe.

Figure 6C:
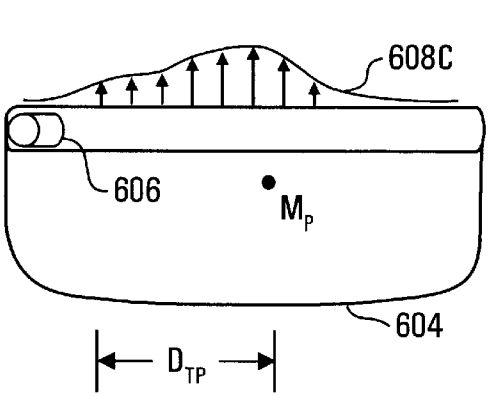
FIGS. 6A–6C are pictorial representations of a head design shown in a variety of configurations and further depicting the control vectors associated with the respective club configurations.
Figure 6B:
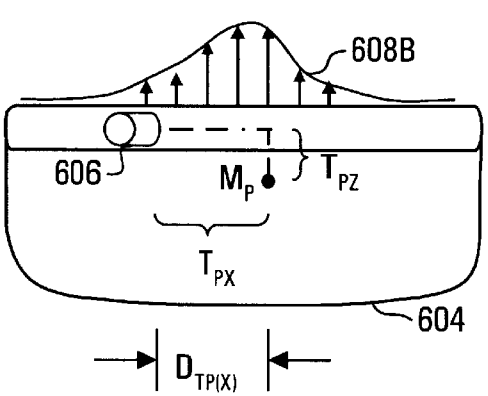
Figure 6A:
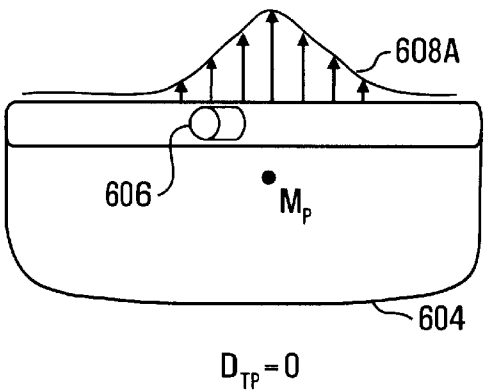

FIGS. 6A–6C are pictorial representations of the head design shown in FIGS. 5A–5C, in a variety of configurations and further depict the control vectors associated with the respective club configurations. Control envelopes 608A–608C exhibit the same relationship with putter torque arm $d_{Tp}$ that was discussed above but the design of head 604 is somewhat complicated by the inclusion of shoe 505. Considering FIG. 6B, notice that head moment $M_p$ is now positioned to the rear of shaft 606 on head 604. Therefore, rather than merely contending with the affects of $d_{Tp}$ on $M_p$ relative to the X axis, $d_{Tp}$ now has a Z axis component forming torque arms $T_{px}$ and $T_{pz}$. The overall control of club configuration depicted in FIGS. 6A–6C, as portrayed by control envelopes 608A–608C is observably less than in club configurations FIGS. 2A–2C, yet clubs designed and configured similar to those pictured in FIGS. 6A–6C are still popular choices for golfers. Apparently, the advantage of being able to use a putter on rough turf is considered significant by at least some golfers.

Figure 7:
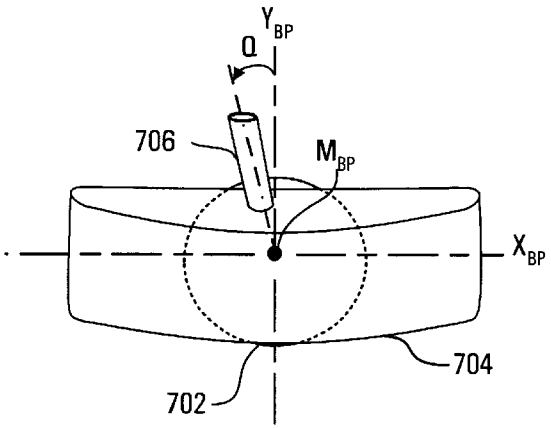
FIG. 7 is a diagram of a rear facing view of an exemplary traditional wedged mallet.
Figure 8C:
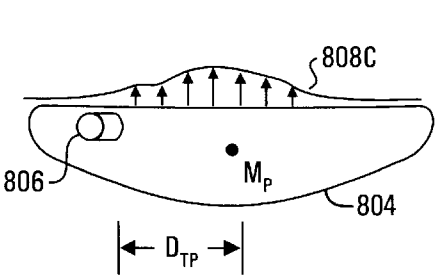
FIGS. 8A–8C are pictorial representations of a wedged mallet in a variety of configurations with the associated control vectors associated with the respective club configurations.
Figure 8B:
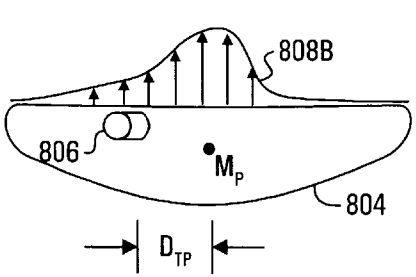
Figure 8A:
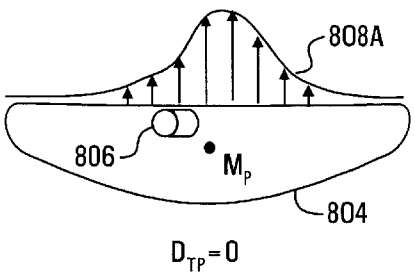

With respect to FIG. 7 and FIGS. 8A–8C, an exemplary diagram of a rear facing view of a more traditional wedged mallet is depicted in FIG. 7 along with pictorial representations of the wedged mallet in a variety of configurations with the associated control vectors associated with the respective club configurations in FIGS. 8A–8C. Wedged mallet head 704 (and 804) is an extremely ancient design that may extend as far back in time as to when putter heads were fashioned from wood. The shear volume of head 704 substantially increases its mass, especially when head 704 is comprised of metal alloys. Shaft 706 attaches to head 704 forming a shaft torque angle θ with the Y axis similar to other club configurations discussed and head moment $M_p$ is now positioned to the rear of shaft 806 on head 804 as more clearly shown in FIGS. 8A–8C. Here again, with this club configuration a golfer must overcome the affects of $d_{Tp}$ on $M_p$ relative to the X axis and a $d_{Tp}$ relative to the Z.

Control envelopes 808A–808C depicted in FIGS. 8A–8C are unremarkable and predict a reduction of control at contact points along the face of head 804 inversely proportional with putter torque arm $d_{Tp}$. Overall, the empirically derived control data for head 804, configured as shown in FIGS. 8A–8C, suggests that controllability is lower than most clubs tested. Perhaps the lower controllability explains some of the loss of popularity of the club design and configuration, albeit periodic resurgence.

Turning now to FIG. 9, an exemplary rear facing view of a perimeter weighted club head is depicted. Shaft 906 attaches to head 904 forming a shaft torque angle θ with the Y axis similar to other club configurations discussed and in addition perimeter weights 905 positioned on either side of $M_p$. Along with pictorial representations of the perimeter weighted club head in FIG. 9, a variety of configurations with the associated control vectors associated with the respective club configurations is depicted for the perimeter weighted club head in FIGS. 10A–10C. Perimeter weighted head 904 (and 1004) has been touted as an extremely stable head design and therefore highly controllable. Prior to acquiring the empirical control data, it was assumed that perimeter weighted head 904 actually performed well because perimeter weights 905 dampened the harmonics induced in head 904 and thereby increased perimeter weighted head 904's overall design efficiency. Machine generated test data seemed to indicate that results obtained from perimeter weighted head 904 were at least more consistent, due ostensibly, to perimeter weights 905.

FIGS. 10A–10C are diagrams of club configurations including control envelopes 1008A–1008C. Again, similar to other club designs and configurations discussed above control envelopes 1008A–1008C represent a reduction of control at contact points along the face of head 1004 inversely proportional with putter torque arm $d_{Tp}$. However, the overall magnitude of controllability computed from the empirically derived control data for head 1004, configured as shown in FIGS. 10A–10C, suggests that controllability is much higher than most clubs tested. Apparently the perimeter weighting premise has merit, even with respect to controllability and the inclusion of perimeter weights 1005 increase control as well as stability (recall, herein controllability is defined as a human factors metric).

Summarizing the testing results, several factors became apparent with respect to club controllability. Initially, with regard to club configuration, the importance of the position on the club head where the shaft force, $F_s$, the force component of the shaft torque arm, $T_s$, is applied with respect to head moment, $M_p$. A corollary conclusion to that of the positioning of the shaft force, $F_s$, with respect to club design, is that while the position of head moment, $M_p$, is important, the distribution of mass across a head is also determinative of controllability. This fact was suggested by the results of the perimeter weighted head tests. It is postulated, therefore, that controllability may be increased for a club by distributing the shaft force, $F_s$, across the striking structure, the area of the club head's face, rather than narrowly focusing $F_s$ at a single point through the application of the shaft torque arm, $T_s$, on the head. Next, it is also postulated that controllability for an object may be increased in an inelastic collision with another object when object moment $M_o$ precedes the collision point on the object. While this is not possible with spherically shaped objects, it may be with a golf club that uses a striking face for contacting the ball but has force applied from another structure, the shaft. The club head design might be such that head moment $M_p$ is moved forward, at least to the contact point with the ball and possibly inside the volume of the ball itself, at the instant of contact. Assuming the above supposition to be correct, it is still further postulated that controllability may be increased for a club by distributing the shaft force, $F_s$, across the striking structure and applying the shaft torque arm, $T_s$, close to or forward of the striking face, inside the volume of the ball, or even forward of ball moment $M_b$ Anecdotally, it is easier to control the swing by pulling it rather than pushing it. Finally, it is apparent that no amount of engineering will result in a club head design and/or configuration that maximizes controllability for each golfer. The frequency distribution of control data values, discussed above, that human factors are more individualized than first assumed. Although no factual basis has been established for the notion, it is probable that individuals have innate talents that are not suggested by their physical attributes, age, gender or skill level. Anecdotal evidence abounds for this proposition: the skeet shoot who hit a clay bird the first time ever firing a gun, and never misses; the batter who has hit practically every baseball ever pitched toward the plate; the billiard player who ran the table the first time holding a cue; and all of the athletes who stay at the top of their respective sports without effort or practice. Therefore and finally, it is also postulated that controllability may be increased for a club and maximized for a particular golfer by configuring a club to match the individual while, simultaneously, distributing the shaft force, $F_s$, across the striking structure and/or repositioning the shaft torque arm, $T_s$, as postulated above. In view of the forgoing, a novel club head design and configuration is presented which overcomes the shortcomings of prior art club head designs and configurations by increasing controllability for the user.

Figure 11A:
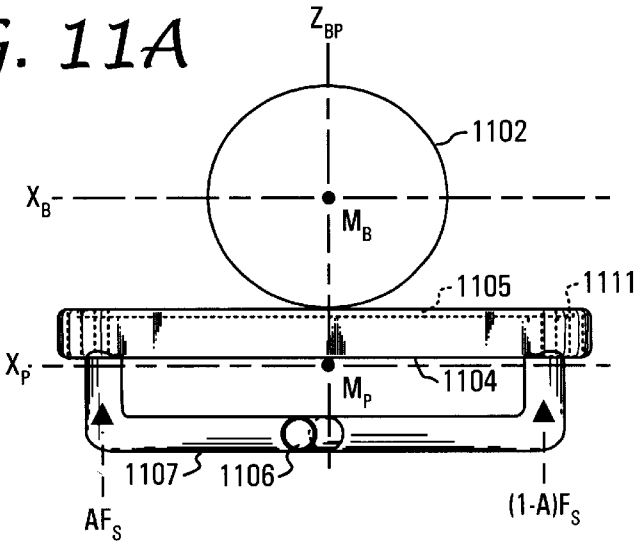
FIGS. 11A–11C are view diagrams depicting a club head and configuration in accordance with an exemplary embodiment of the present invention.
Figure 11C:
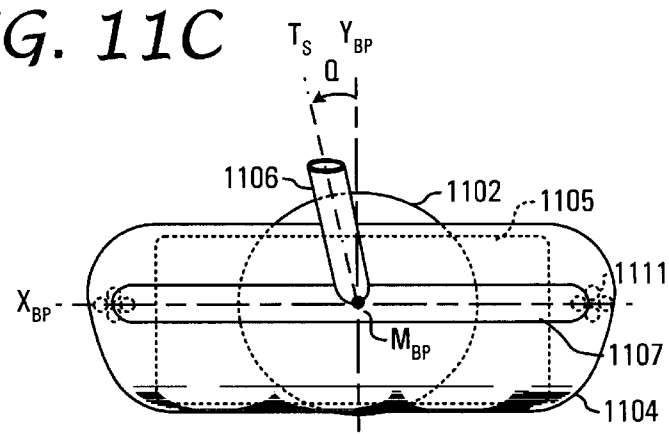
Figure 11B:
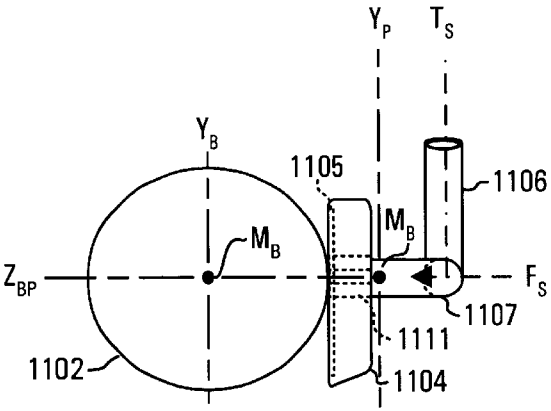

FIGS. 11A–11C are view diagrams depicting a club head and configuration in accordance with an exemplary embodiment of the present invention. Further, with respect to FIGS. 11A–11C, the alignment of the club head 1104 is present with ball 1102 in further accordance with an exemplary embodiment of the present invention. FIG. 11A is a plan view, FIG. 11B is a side view and FIG. 11C is a rear facing view of ball 1102 with head 1104. Shaft 1106 is oriented at shaft torque angle θ with the Y axis, similar to other club configurations, but rather than connecting to head 1104, shaft 1106 is affixed to berish bracket 1107.

Berish bracket 1107 is presented here in exemplary form in a U-shaped configuration with either distal end attached to the rear extremities of head 1104. Berish bracket 1107 offsets the connection position of shaft 1106 to the rear of head 1104 by a predetermined distance and therefore head moment $M_p$ is repositioned rearward from head 1104 due to the mass of berish bracket 1107. With respect to the exemplary embodiment depicted in FIGS. 11A–11C, berish bracket 1107 is coplanar with the X-Z plane and head moment $M_p$ of head 1104. Berish bracket 1107 is also coplanar with ball moment $M_b$ for ball 1102, along the X and Z axes. Maintaining a coplanar orientation for berish bracket 1107 is helpful for focusing $F_s$ directly toward $M_b$. Even more helpful is maintaining all of berish bracket 1107, $M_p$ and $M_b$ in a coplanar configuration, or as close as practical, for focusing $F_s$ directly toward $M_b$, through $M_p$.

The application of a subdivided shaft torque, $T_s$, at or near distal edge portions of head 1104 and distributed across head 1104 as shaft forces of $aF_s$ and $(1-a)F_s$ substantially increases the control and handling attributes of the club.

In addition to the depicted head design, perimeter weights 1111 may also be incorporated at positions on either side of $M_p$, similar to perimeter weights 905 shown in FIGS. 9–10 above. Of course, in the present case the location of the perimeter weights would be slightly ahead of $M_p$, within head 1104.

Also depicted in FIGS. 11A–11C is optional insert 1105 which may be comprised of balata, copper, milled face, aluminum, brass, bronze, titanium or any material with desired physical properties. For the purposes of the present invention, insert 1105 is either fixed or replaceable and may in fact be layered composition of materials, for instance, balata covered by bronze. Moreover, entire berish bracket 1107 may be removabably attached to head 1104.

While other configurations of berish bracket 1107 are possible, and indeed will be disclosed herewithin, each exemplary embodiment provides for multiple attachment points between the berish bracket and the club head, wherein the bio-kinetic energy, in the form of shaft torque, $T_s$, is applied to the head at more than a single position. The resulting increase in control for the exemplary club utilizing berish bracket 1107 is represented in FIGS. 12A–12C.

Figures 12A, 12B, 12C:
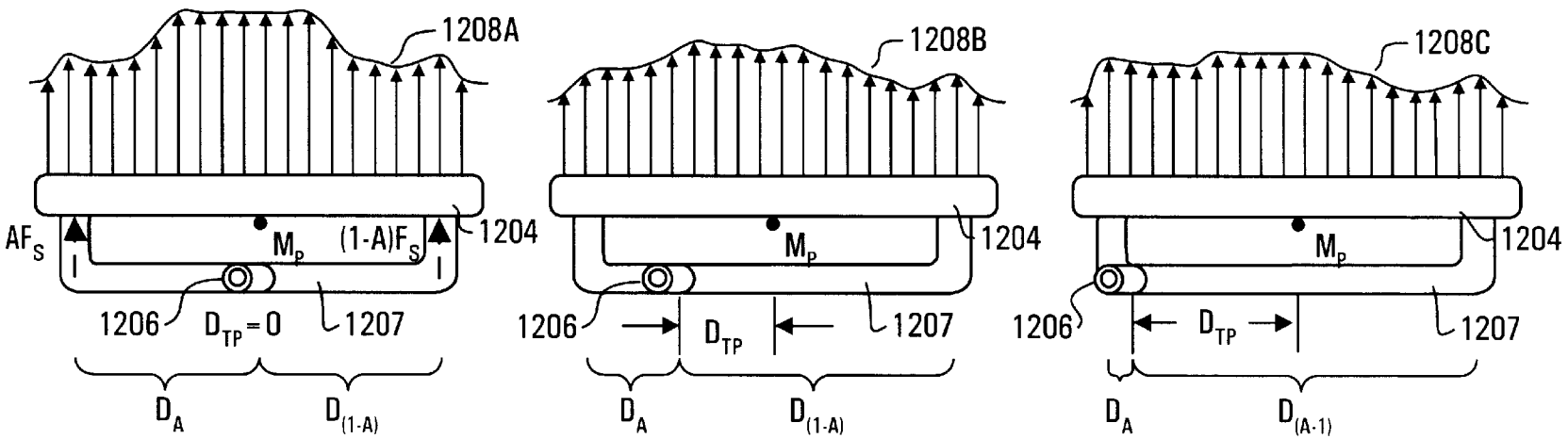
FIGS. 12A–12C depict empirically derived control indicators represented as arrows extending from the face of the club head of the are exemplary club design and configuration shown in FIGS. 11A–11C.

Turning now to FIGS. 12A–12C, the club design and configuration as described above in FIGS. 11A–1C is shown accompanied with empirical control indicators represented as arrows extending from the face of head 1204. Head configurations depicted in FIGS. 12A–12C differ only in the position in which shaft 1206 connected to head 1204, FIG. 12A representing the configuration shown in FIG. 11 above with shaft 1206 protruding from the approximate center of berish bracket 1207 and in line (coplanar) with $M_p$. In accordance with this exemplary embodiment, the closest distance, $d_{Tp}$, between torque arm $T_s$ and the head moment for head 1204, $M_p$ is equal to zero as torque arm $T_s$ intersects $M_p$. In this configuration shaft force $F_s$, resulting from shaft torque $T_s$ being applied to berish bracket 1207, is distributed to positions on the rear facing side of head 1204. The magnitude of the shaft force, $F_s$, applied at the separate connection points can be determined from the relative position of shaft 1206 along berish bracket 1207. In FIGS. 12A–12C the X component length of berish bracket 1207 is d and therefore position of shaft 1206 on berish bracket 1207 can be computed as (a·d), a being a ratio, and denoted as $d_a$ from one end of bracket 1207, with $d_{(1-a)}$, (d(1-a)), representing the shafts position from the opposite end. The magnitude of shaft force $F_s$ at either connection point can be approximated using the same ratio, $aF_s$ at the first connection point and (1-a)$F_s$ at the second connection point. Approximations of shaft force $F_s$ can be likewise computed for more than two connection points as a ratio of the position of shaft 1206 with respect to each connection, remembering of course that the sum of all connection point forces must equal to shaft force $F_s$ being applied by the golfer as shaft torque $T_s$. Also remember that shaft 1206 is not coincidental with any axes and instead forms a shaft torque angle θ to the Y axis, around the Z axis in the Z-X planes.

Associated with each head configuration depicted in FIGS. 12A–12C is a set of control vectors that define a control envelope for the club, envelope 1208A, that correspond to the head configuration shown in FIG. 12A, envelope 1208B corresponds to the head configuration shown in FIG. 12B and envelope 1208C corresponds to the head configuration shown in FIG. 12C. Here again, each of the control data vectors is a measure of empirically derived data that represents a normalized approximation of efficiency, consistency and predictability of the transfer of bio-kinetic energy from a group of users to a ball. Envelope 1208 is derived from a plurality of control vectors across the face of head 1204 empirically representing both the predictable physical club attributes and the unpredictable human factors by rating predictions of range and consistency for human subject golfers.

Comparing FIGS. 12A–12C, the relationship between control and $d_{Tp}$, the distance from where shaft 1206 attaches to berish bracket 1207 from head moment $M_p$ (the length of putter torque arm) is no longer apparent. The bell-shaped control envelopes exhibited by club configurations in FIGS. 2, 4, 6, 8 and 10 are missing from envelopes 1208A–1208C. Instead, a measure of control has been extended across the face of head 1204. Notice also that the magnitude of control envelopes has also been increased, virtually across the extent of the face of head 1204. Increased controllability results expected from berish bracket 1207 may vary with the magnitude of shaft force $F_s$. Preliminary results indicate that relative control may vary with the magnitude of shaft force $F_s$, the greater shaft force $F_s$, with respect to the mass of head 1204, the more control. Therefore, increased control may be more apparent on shots requiring larger shaft forces, $F_s$, usually translated from increased shaft speeds. Thus, the increase of controllability is more pronounced on longer shots from the cup.

Figure 13A:
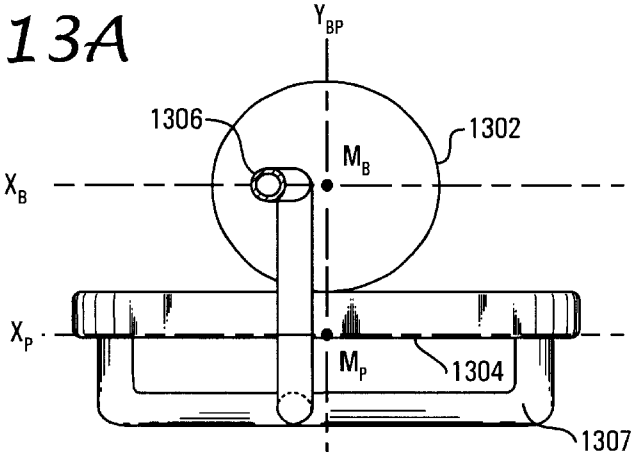
FIGS. 13A–13C are view diagrams of an exemplary club head and configuration are presented in accordance with an exemplary embodiment of the present invention.
Figure 13C:
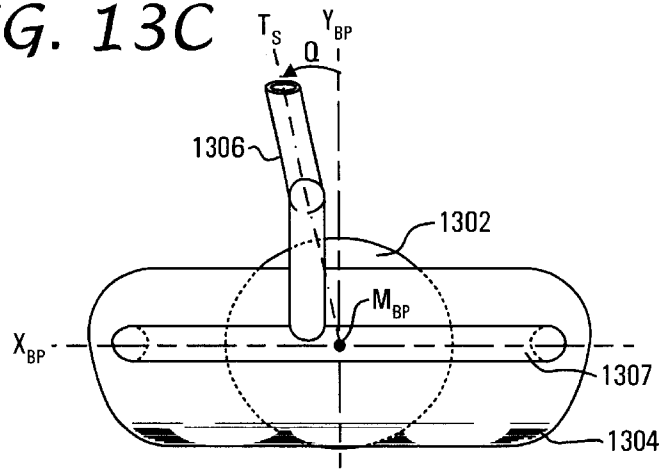
Figure 13B:
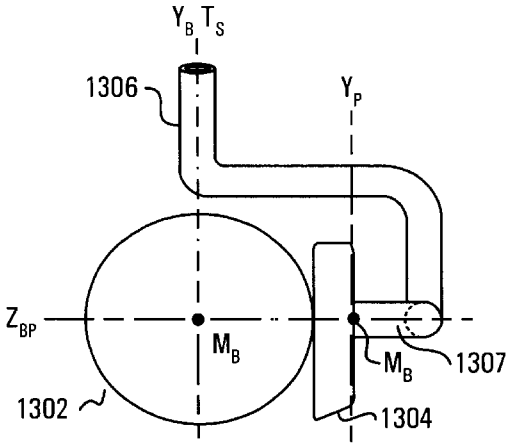

Turning now to FIGS. 13A–13C, view diagrams depicting a club head and configuration are presented in accordance with an exemplary embodiment of the present invention. Here, head 1304 is identical to that described above with respect to FIGS. 11A–11C and is aligned with ball 1302 in the same manner as discussed above. FIG. 13A is a plan view, FIG. 13B is a side view and FIG. 13C is a rear facing view of ball 1302 with head 1304. Shaft 1306 is oriented at shaft torque angle θ with the Y axis and is affixed to berish bracket 1307. However, rather than being coplanar with the Y axis, shaft 1306 extends downward from the handle or grip to a point directly over ball 1302 and then proceeds rearward over head 1304 and finally down to the attachment point on berish bracket 1307. In this configuration, shaft torque $T_s$ is applied forward of head moment $M_p$. With respect to the present exemplary embodiment, shaft torque $T_s$ is substantially directed toward ball moment $M_b$ for ball 1302. Controllability is thereby further increased by distributing the shaft force, $F_s$, across the striking structure and applying the shaft torque arm, $T_s$, toward ball moment $M_b$.

Figures 14A, 14B, 14C:
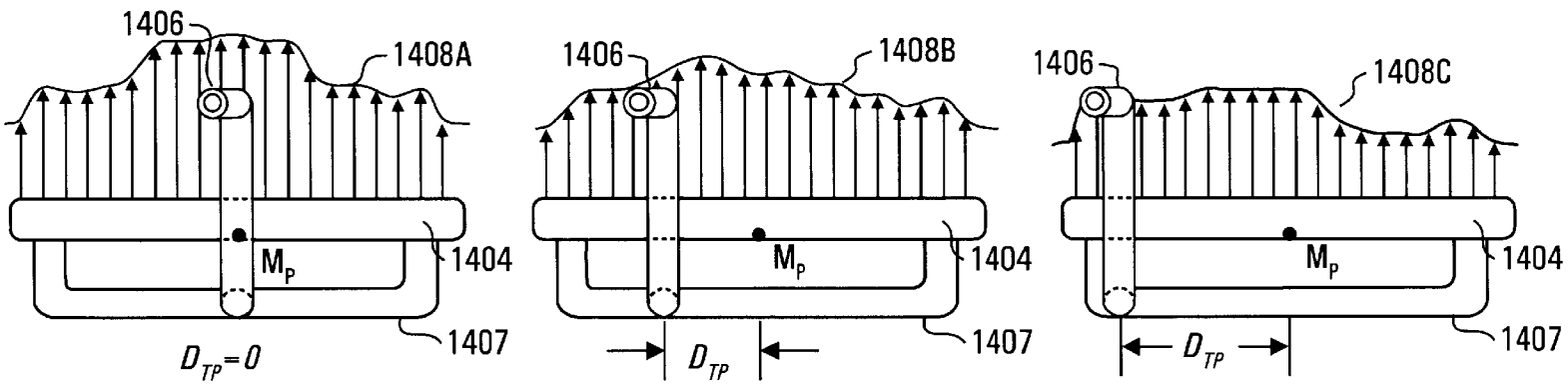
FIGS. 14A–14C are diagrams depicting control envelopes for the present configuration of a club head and shaft in accordance with an exemplary embodiment of the present invention.
Figure 15A:
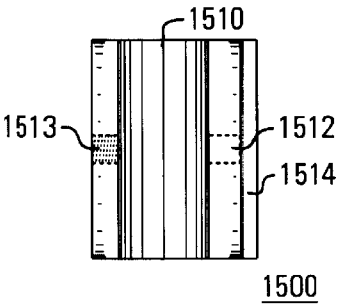
FIGS. 15A–15F depict a bracket adjustment part in accordance with an exemplary embodiment of the present invention with FIG. 15B illustrating a lateral side view, FIG. 15D illustrating a rear side view and FIG. 15F illustrating a front side view, with FIGS. 15A, 15C and 15E illustrating respective plan views for each side view.
Figure 15B:
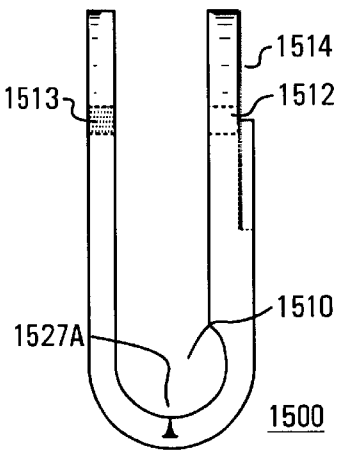
Figure 15C:
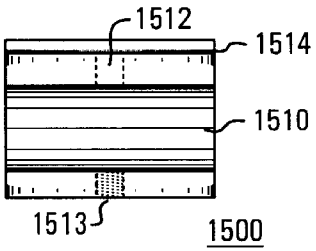
Figure 15D:
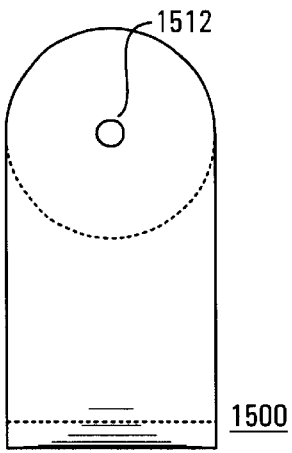
Figure 15E:
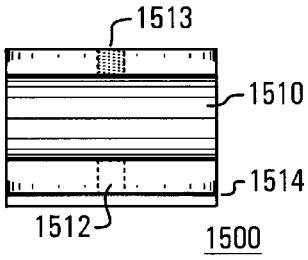
Figure 15F:
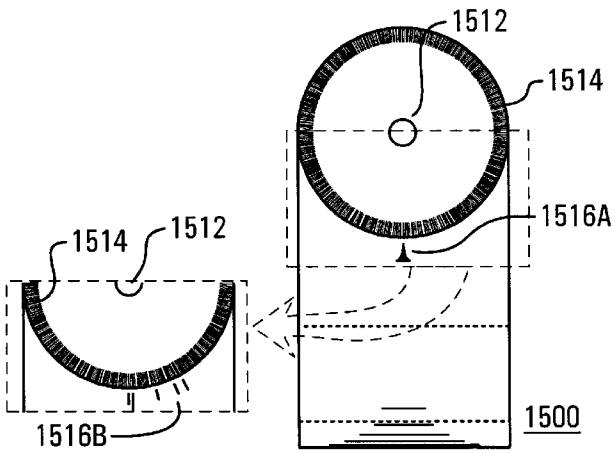

FIGS. 14A–14C are diagrams depicting control envelopes 1408A–1408C for the present configuration of head 1402 and shaft 1406 in accordance with an exemplary embodiment of the present invention. Notice that the control envelopes compare favorably to any exhibited by club configurations in FIGS. 2, 4, 6, 8 and 10 and may be somewhat increased over respective control envelopes shown in FIGS. 12A–12C.

The berish bracket allows for articulable club configurations that were heretofore unknown. Even with the increased controllability afforded by the berish bracket, control might be optimized even further for an individual. Recall that the frequency distribution of control data values for contact points along the face of a club head tended to vary more than might have been statistically predicted. Thus, the source of human factors components apparently cannot be completely generalized. The berish bracket allows for exceptional controllability, generally, and individualizing club configuration for further optimizing control for a golfer.

On a related subject, club configurability has been attempted in the prior art without a lasting impact on the art. A fully configurable club, a putter for instance, would allow users to customize club configurations without the expense of buying new clubs having the desired configurations. Clearly a need exists for different devices and techniques to replace the status-quo configurable clubs. In accordance with an exemplary embodiment of the present invention, a club is presented with six degree-of-adjustability.

Referring again to FIGS. 1A–1C, a local coordinate system can be defined for any object, with respect to putter 104A a local coordinate system is defined by axis and $X_p$, $Y_p$ and $Z_p$ respectively. The origin of a local coordinate system may be translated to any position on or off the particular object using relative simplistic matrix operations which are unimportant for the purposes herein. In the case of head 104, the origin of the $X_p$, $Y_p$, $Z_p$ is centered at the moment $M_p$ but might instead be positioned at the face of head 104. Six degree-of-adjustability refers to club configerability in six movement directions. These direction are: translation parallel to the X axis; translation parallel to the Y axis; translation parallel to the Z axis; rotation around the Y axis, angle λ; rotation around the X axis, angle Φ; and rotation around the Z axis, angle θ. Adjustability in some of these six directions, x, y, z, ϕ, λ, θ, adds configurability to a club. Adjustability in all of these six directions, x, y, z, ϕ, λ, θ, adds infinite configurability to a club and that club might be configured to have the feel and handling of another club. Therefore, and in accordance with another exemplary embodiment of the present invention, a club head and associated berish bracket is provided with six degree-of-adjustability.

FIGS. 15–18 are diagrams of an exemplary adjustment mechanism for providing multi degree-of-adjustability to a club in accordance with an exemplary embodiment of the present invention, while are diagrams FIGS. 15–20 depict an exemplary adjustment mechanism for providing six degree-of-adjustability to a club in accordance with another exemplary embodiment of the present invention. The adjustment mechanism is illustrated in FIGS. 17A and 17B, side view and front view respectively. The mechanism or knuckle, is comprised of a bracket adjustment part 1500 and shaft adjustment part 1600, respectively shown in FIGS. 15 and 18. Bracket adjustment part 1500 is depicted in FIGS. 15A–15F with FIG. 15B illustrating a lateral side view, FIG. 15D illustrating a rear side view and FIG. 15F illustrating a front side view, with FIGS. 15A, 15C and 15E illustrating respective plan views for each side view. As shown in FIGS. 15A–15F, exemplary bracket adjustment part 1500 is formed from "U" shaped stock material with bracket receiver 1510 that accepts and clamps to the berish bracket. Opposite bracket receiver 1510 on bracket adjustment part 1500 is screw hole 1512 that penetrates the center of circular receiver 1514 that cooperates with a corresponding circular receiver on shaft adjustment part 1600. Circular receiver 1514 may be lined with equally spaced teeth, as depicted in FIG. 15F, or may alternatively merely be a roughened or etched surface capable of positively engaging the corresponding circular receiver on shaft adjustment part 1600. Also provided on bracket adjustment part 1500 is threaded hole 1513 for receiving a screw or bolt threads from an aperture formed by screw hole 1512. The alignment of threaded hole 1513 and screw hole 1512 is approximately perpendicular to the axially shaped portion of bracket receiver 1510, thereby providing a means for securely tightening bracket adjustment part 1500 around the berish bracket.

Notice that pointer indicator 1516A is provided on bracket adjustment part 1500 adjacent to circular receiver 1514 for alignment with graduated degree indicators on shaft adjustment part 1600. Through the use of pointer indicator 1516A, the knuckle can be accurately adjusted to a specific shaft angle, angle θ. Notice also that graduated indicator 1516B is provided as an alternative to needle indicator 1516A for more fine angle adjustment. Graduated indicator 1516B has several line indicators for adjusting to the nearest degree, half degree and quarter degree for lining with graduated degree indicators on shaft adjustment part 1600 (in practice graduated indicators are several times more accurate than a single, non-graduated pointer). Also notice that pointer indicator 1527A is provided on the latter edge of bracket adjustment part 1500 adjacent to bracket receiver 1510 for alignment with graduated degree indicators scored into the berish bracket. The loft of the club head, angle Φ, can be accurately adjusted using pointer indicator 1527A in conjunction with the degree indicators scored into the berish bracket (a graduated indicator might also be used but not shown). In addition, adjustments in the X direction are accomplished by moving bracket adjustment part 1500 linearly along the berish bracket.

Figure 16A:
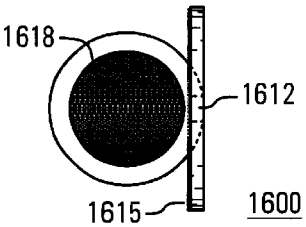
FIGS. 16A–16F depict a shaft adjustment part in accordance with an exemplary embodiment of the present invention with FIG. 16B illustrating a lateral side view, FIG. 16D illustrating a rear side view and FIG. 16F illustrating a front side view, with FIGS. 16A, 16C and 16E illustrating plan views of the respective side views.
Figure 16B:
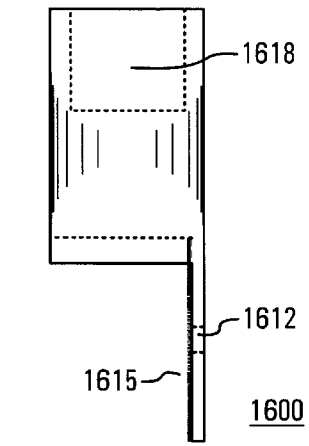
Figure 16C:
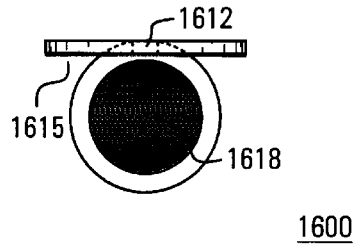
Figure 16D:
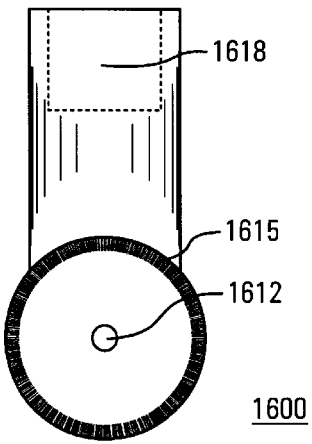
Figure 16E:
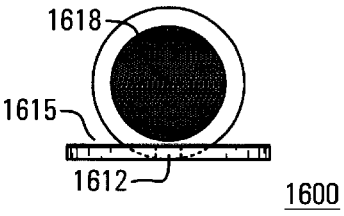
Figure 16F:
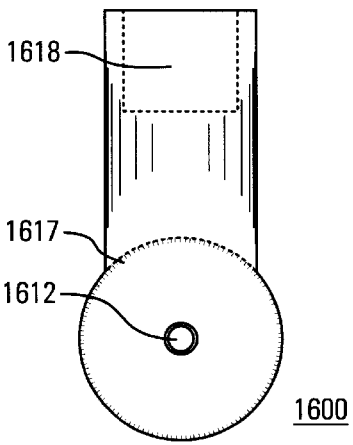

Turning now to FIGS. 16A–16F, shaft adjustment part 1600 is depicted with FIG. 16B illustrating a lateral side view, FIG. 16D illustrating a rear side view and FIG. 16F illustrating a front side view, with FIGS. 16A, 16C and 16E illustrating plan views of the respective side views. As shown in FIGS. 16A–16F, exemplary shaft adjustment part 1600 comprises adjustable shaft receiver 1618 at one end and circular receiver 1615 at the opposite end. Circular receiver 1615 may also be lined with equally spaced teeth, as depicted in FIG. 16D, or may alternatively merely be a roughened or etched surface capable of positively engaging the circular receiver 1615 on bracket adjustment part 1600. The opposite face of circular receiver 1615 is marked with graduated degree indicators 1617 used for making specific angle θ adjustment on the knuckle. Shaft adjustment part 1600 is firmly fastened to bracket adjustment part 1500 with a screw or bolt (not shown) that passes through both screw holes 1612 and screw hole 1512 and secures in threaded hole 1513, shown in FIGS. 15A and 15E. A shaft is secured in adjustable shaft receiver 1618 via set screws (not shown) or other calibrated locking means capable of securely holding a shaft at a predetermined orientation, angle λ. Angle λ allows the club shaft and grip to be reoriented from one golfer to another, especially from a right handed golfer to left handed, or visa versa.

Figure 17B:
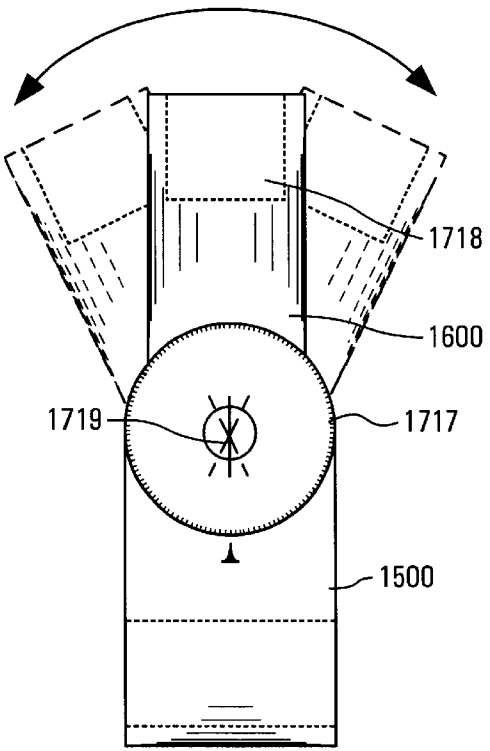
FIGS. 17A and 17B illustrate the cooperation between bracket adjustment part 1500, shaft adjustment part 1600 and berish bracket 1707 in accordance with an exemplary embodiment of the present invention.
Figure 17A:
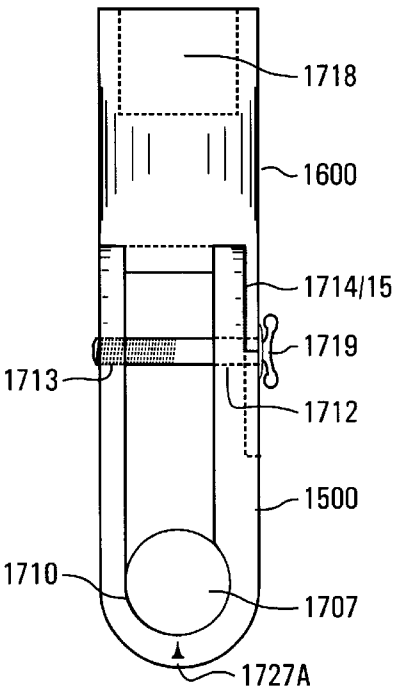

FIGS. 17A and 17B illustrate the cooperation between bracket adjustment part 1500, shaft adjustment part 1600 and berish bracket 1707 in accordance with an exemplary embodiment of the present invention. Screw 1719 passes through screw hole 1712 and secures in threaded hole 1713 and when tightened, firmly secures circular receiver 1715, on shaft receiver 1600, to corresponding circular receiver 1715. The knuckle is capable of being adjusted to a wide range of angle θ as shown in FIG. 17B, giving a golfer an adjustment means for varying the distance from the putting stance to the resting ball. Angle θ adjustments are often made in custom club configuration based on a golfer's height. Taller golfers usually require a less pronounced angle θ.

Figure 18B:
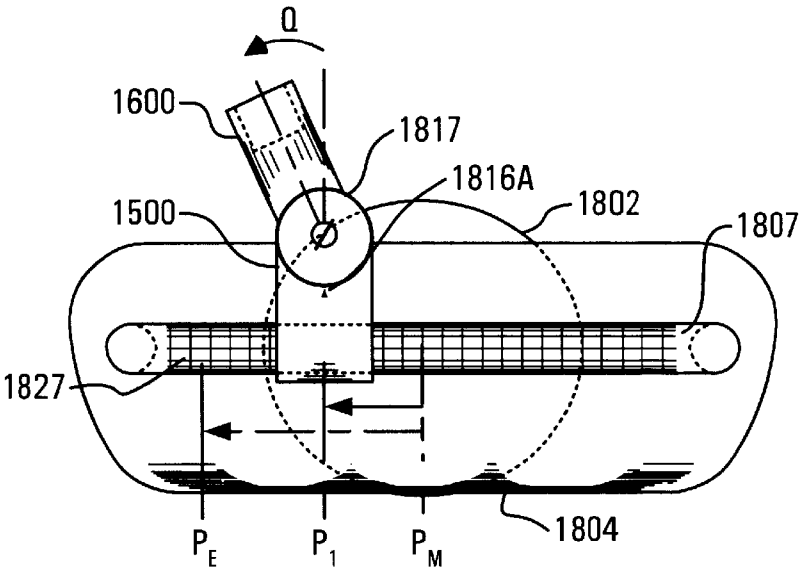
FIGS. 18A and 18B are diagrams depicting the knuckle secured to a club head using a berish bracket in accordance with an exemplary embodiment of the present invention.
Figure 18A:
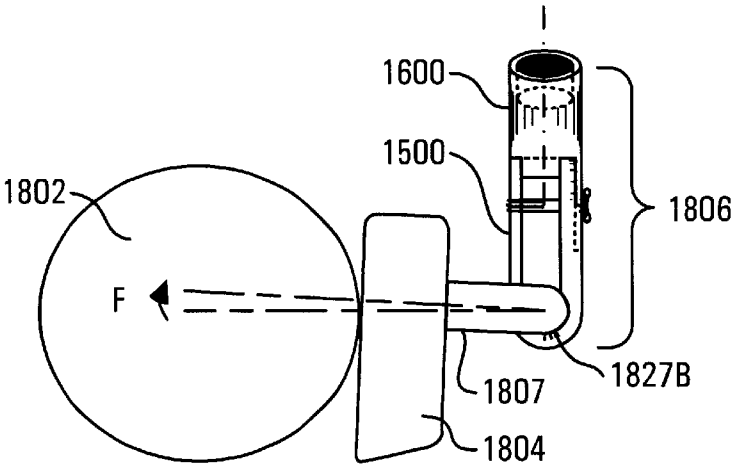

FIGS. 18A and 18B are diagrams depicting the knuckle secured to a club head using a berish bracket in accordance with an exemplary embodiment of the present invention. As seen in the illustrations, berish bracket 1807 is securely affixed to club head 1804 at either end while bracket adjustment part 1500 is compressed around the lateral shaft of bracket 1807. Shaft adjustment part 1600 is joined to bracket adjustment part 1500 as previously discussed with a shaft (not shown) extended upward With respect to FIG. 18B, notice that indicators 1827 are etched into the lateral extent of berish bracket 1807. Indicators 1827 are composed of radial indices, depicted as vertical indicators, and linear indices that are depicted as horizontal indicators. The radial indices are used in conjunction with either vertical edge of bracket adjustment part 1500 for metering adjustments in the X direction are accomplished by moving bracket adjustment part 1500 linearly along berish bracket 1807. For example, bracket adjustment part 1500 can be incrementally repositioned from positions $P_m$ to $P_l$ to the end position $P_e$ as depicted in FIG. 18B. The linear indices, on the other hand, are used in conjunction with one of either graduated indicator 1827B or a needle indicator (not shown) for radially adjusting bracket adjustment part 1500 with respect to berish bracket 1807. The loft of head 1804, angle Φ, can be accurately adjusted using pointer indicator 1827B in conjunction with linear indices 1827 scored into berish bracket 1807.

In addition to make loft adjustment, angle θ adjustments are also made by rotating shaft adjustment part 1600 with respect to bracket adjustment part 1500 prior to tightening the locking screw. Here again accurate adjustments are possible because shaft adjustment part 1600 and bracket adjustment part 1500 are marked with graduated indices corresponding to increments of angle θ.

While the above described embodiments give a user a multi degree-of-adjustability means for configuring a club, shaft adjustment part 1600 and bracket adjustment part 1500 do not provide a sufficient degree of articulate for full range articulative adjustments, six-degrees. Instead two articuable knuckles must be combined, or piggy-backed, to provide the deficient degrees. However, two knuckles as shown in FIGS. 17A and 17B are not configurable together because both are designed to accommodate a shaft and berish bracket. Therefore, a combination adjustment part supplements one of the shaft adjustment brackets.

FIGS. 19A–19F depict combination adjustment part 1900, FIG. 19B illustrates a lateral side view, FIG. 19D illustrates a rear side view and FIG. 19F illustrates a front side view, and FIGS. 19A, 19C and 19E illustrate plan views of the respective side views. As is evident from the figures, combination adjustment part 1900 is similar to the shaft adjustment part described above, differing only with the inclusion of false bracket 1926 in place of the shaft receiver. False bracket 1926 is identical to the lateral portion of a berish bracket including the scoring of indices 1927 scored into false bracket 1927 for accurate adjustments.

Figure 20B:
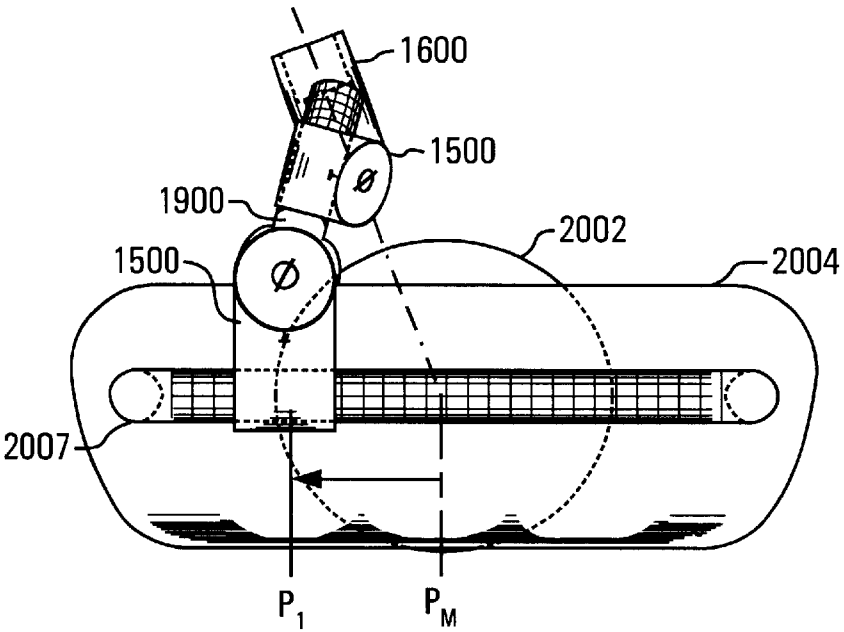
FIGS. 20A–20B depict an adjustment mechanism for providing six degree-of-adjustability to a club in accordance with another exemplary embodiment of the present invention.
Figure 20A:
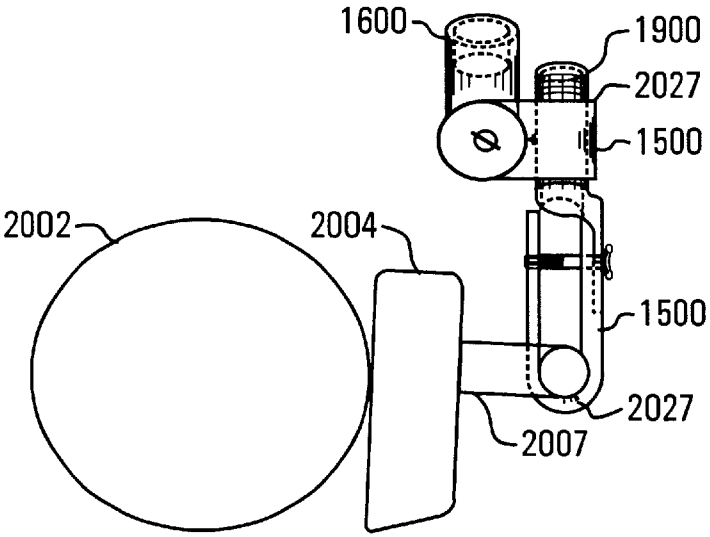

Turning now to FIGS. 20A–20B, an exemplary adjustment mechanism is depicted for providing six degree-of-adjustability to a club in accordance with another exemplary embodiment of the present invention. As shown in the illustration, two articuable knuckles are combined, piggy-backed, to provide six-degree-adjustability to the club. The exemplary club configuration require two bracket adjustment parts 1500, configures to either end of combination adjustment parts 1900. The first bracket adjustment part 1500 clamps onto berish bracket 2007 and screws to combination adjustment parts 1900 in the disclosed fashion. However, rather than a shaft receiver, combination adjustment parts 1900 has an upturned false bracket for the second bracket adjustment part to clamp to. Second bracket adjustment part 1500 and shaft adjustment part 1600 are joined in the manner prescribed above but at an approximately right angle to the first knuckle.

The combination of the two knuckles in accordance with an exemplary embodiment of the present invention allows for infinite configurability to a club by providing adjustability in all six directions, x, y, z, ϕ, λ, θ, thus the feel and handling of the club can be modified to suit the user. Furthermore, controllability may be increased for a club by applying the shaft torque arm, $T_s$, forward of the striking face, as well as distributing the shaft force across club head 2004 via berish bracket 2007. Finally, because the human factors affecting controllability seem to be more individualized than once appreciated, the present invention allows a golfer to optimize controllability over that imparted by the berish bracket, and taking advantage of innate aptitude for a particular configuration.

Moreover, in accordance with still another exemplary embodiment of the present invention the exemplary adjustment mechanism is depicted in FIGS. 20A and 20B is capable of mimicking the feel and handling attributes of other clubs. Because the present invention allows for six degree-of-adjustability, a club remains fully configurable with the berish bracket. Therefore, even though the present club head design that incorporates the bracket does not suggest another club design, a golfer might configure the club such that its swing and handling are identical to a specific club, for instance a favorite club for a golfer. Calculating accurate "mimicking" adjustments is a difficult process, probably above the level of complexity that could reasonably be expected to be resolved by the average golfer. Therefore, so as not to burden the user with endless adjusting and testing and more adjusting, a correspondence table is computed by the manufacturer for the convenience of golfers. Below is an exemplary table, Table I, containing mimicking adjustments for six clubs, types A–F.

TABLE I (Conversion Chart)

| | Berish Angle | Berish Distance | Lower Control Angle | False Berish Angle | False Berish Distance | Upper Control Angle | Shaft Control |
|---|---|---|---|---|---|---|---|
| Type "A" RH | +0 | 5L and 17R | +15.0 | −41.0 | 0L and 22R | −73.5 > 6'4" | +10 |
| | | | | | | −73.0 > 6'2" | +10 |
| | | | | | | −72.5 > 6'0" | +10 |
| | | | | | | −72.0 > 5'10" | +10 |
| | | | | | | −71.5 > 5'8" | +10 |
| | | | | | | −71.0 > 5'6" | +9.5 |
| | | | | | | −70.0 > 5'4" | +9.5 |
| | | | | | | −69.0 > 5'2" | +9.5 |
| | | | | | | −67.5 > 5'0" | +9.5 |
| | | | | | | −66.0 < 5'0" | +9.5 |
| Type "A" LH | +0 | 17L and 5R | −15.0 | −41.0 | 0L and 22R | −73.5 > 6'4" | +190 |
| | | | | | | −73.0 > 6'2" | +190 |
| | | | | | | −72.5 > 6'0" | +190 |
| | | | | | | −72.0 > 5'10" | +190 |
| | | | | | | −71.5 > 5'8" | +190 |
| | | | | | | −71.0 > 5'6" | +189.5 |
| | | | | | | −70.0 > 5'4" | +189.5 |
| | | | | | | −69.0 > 5'2" | +189.5 |
| | | | | | | −67.5 > 5'0" | +189.5 |
| | | | | | | −66.0 < 5'0" | +189.5 |

TABLE I-continued (Conversion Chart)

| | Berish Angle | Berish Distance | Lower Control Angle | False Berish Angle | False Berish Distance | Upper Control Angle | Shaft Control |
|---|---|---|---|---|---|---|---|
| Type "B" RH | +0.5 | 11L and 11R | −2.0 | −0.0 | 3L and 19R | −66.0 > 5'6" | +186 |
| | | | | | | −65.0 < 5'6" | +186 |
| Type "B" LH | +0.5 | 11L and 11R | +2.0 | −0.0 | 3L and 19R | −66.0 > 5'6" | +6 |
| | | | | | | −65.0 < 5'6" | +6 |
| Type "C" RH | +0 | 6L and 16R | +12.0 | −33.0 | 5L and 17R | −71.0 | +11 |
| Type "C" LH | +0 | 16L and 6R | −12.0 | −33.0 | 5L and 17R | −71.0 | +191 |
| Type "D" RH | +1.0 | 5L and 17R | +19.0 | −43.0 | 4L and 18R | −68.0 | +10 |
| Type "D" LH | +1.0 | 17L and 57R | −19.0 | −43.0 | 4L and 18R | −68.0 | +190 |
| Type "E" RH | +0 | 3L and 19R | +2.0 | −5.0 | 2L and 20R | −75.0 > 6'4" | +11 |
| | | | | | | −74.0 > 5'8" | +11 |
| | | | | | | −73.0 > 5'2" | +10 |
| | | | | | | −72.0 <: 5'2" | +9.5 |
| Type "E" LH | +0 | 19L and 3R | −2.0 | −5.0 | 2L and 20R | −75.0 > 6'4" | +191 |
| | | | | | | −74.0 > 5'8" | +191 |
| | | | | | | −73.0 > 5'2" | +190 |
| | | | | | | −72.0 <: 5'2" | +189.5 |
| Type "F" RH | +0.0 | 11L and 11R | +2.0 | −5.0 | 2L and 20R | −75.0 > 6'4" | +10 |
| | | | | | | −74.0 > 5'8" | +10 |
| | | | | | | −73.0 > 5'2" | +10 |
| | | | | | | −72.0 <: 5'2" | +10 |
| Type "F" LH | +0.0 | 11L and 11R | −2.0 | −5.0 | 2L and 20R | −75.0 > 6'4" | +190 |
| | | | | | | −74.0 > 5'8" | +190 |
| | | | | | | −73.0 > 5'2" | +190 |
| | | | | | | −72.0 <: 5'2" | +190 |

It should be understood that a conversion chart is specific to a particular club design, so if a user changes head designs, the user must also obtain a conversion table for that specific head design. Right hand (RH) club configurations, as well as left hand (LH) club configurations are represented in Table I to accommodate conversions for both right handed and left danded golfers. It is expected that most golfers will prefer to mimic a favorite club by duplicating that club's configuration with respect to the contact point on the face of the club head. In so doing a golfer need not readjust stance, grip, swing or follow-through when changing to the new club. However, it is highly unlikely that the moment of mass for club head with a berish bracket will be in the identical position relative to the contact point on its face than the club head being mimicked. Therefore, while the golfer's stance, grip, swing and follow-through may not need adjusting, the golfer might perceive a different feel or handle in the new club due to the change in relative position of the club head's moment of mass. Therefore, the conversion chart values may be slightly altered to accommodate the feel of the new club in addition to its configuration. This would even be more beneficial for golfers where the relative position of mass moment of the club being mimicked differs significantly from the relative position of mass moment of new club head. Alternatively, separate conversion charts could be generated for mimicking contact position and for mimicking relative positions of mass moments to the contact points. Of course, if the relative positions of the moments of mass for the separate clubs did not significantly differ, then only the single conversion chart would suffice as it would accurately both mimic contact positions and relative positions of the mass moments.

Figure 21A:
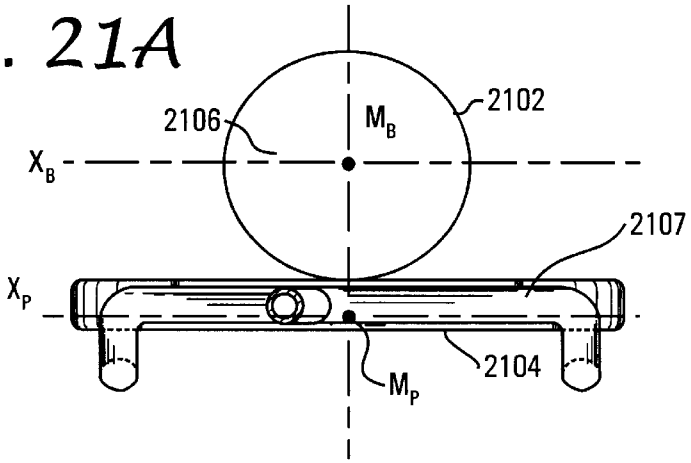
FIGS. 21A–21C are view diagrams of a club head and configuration with the longitudinal member positioned forward of the rear face of the club head and rear of the front face of the club head in accordance with an exemplary embodiment of the present invention.
Figure 21C:
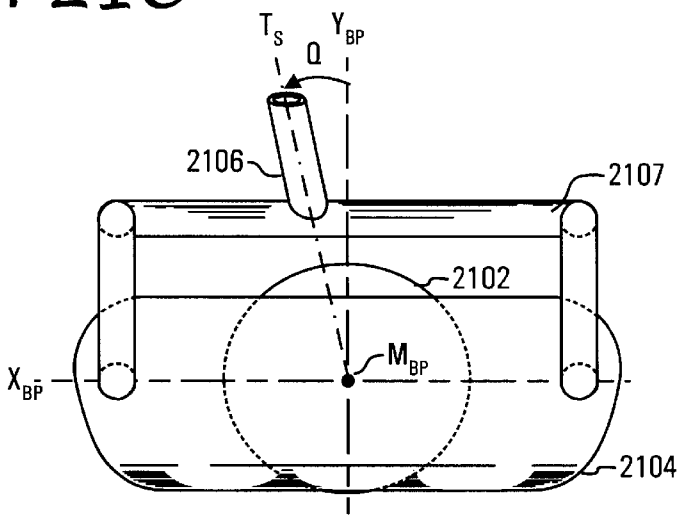
Figure 21B:
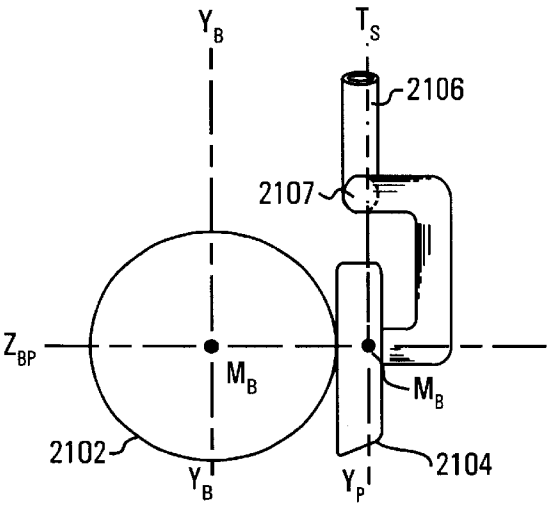

Turning now to FIGS. 21A–21C, view diagrams depicting a club head and configuration are presented in accordance with an exemplary embodiment of the present invention. Here, head 2104 is identical to that described above with respect to FIGS. 13A–13C and is aligned with ball 2102 in the same manner as discussed above. FIG. 21A is a plan view, FIG. 21B is a side view and FIG. 21C is a rear facing view of ball 2102 with head 2104. Shaft 2106 is oriented at shaft torque angle θ with the Y axis and is affixed to berish bracket 2107. However, in accordance with this exemplary embodiment the longitudinal member of berish bracket 2107 is positioned substantially forward of the rear face and rear of the front face of head 2104 while the distal ends of the U-shaped configuration are attached to the rear extremities of head 2104, one distil end being attached between the moment of mass (head moment $M_p$) and the toe portion, and the second distil end is attached to the rear of head 2104 between the moment of mass (head moment $M_p$) and the heel portion.

Figure 22A:
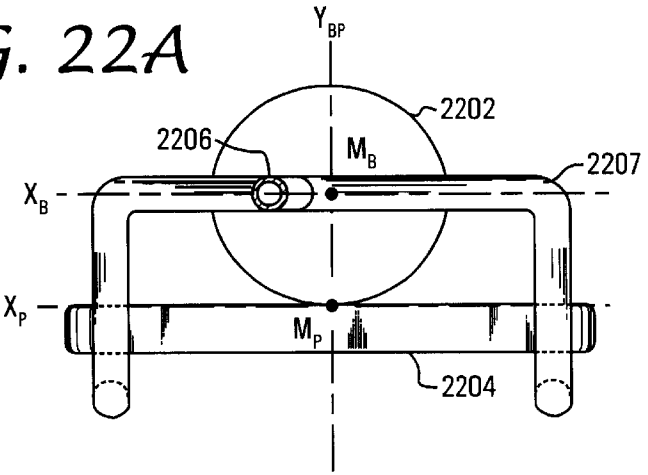
FIGS. 22A–22C are view diagrams of a club head and configuration with the longitudinal member positioned forward of the rear face of the club head in accordance with an exemplary embodiment of the present invention.
Figure 22C:
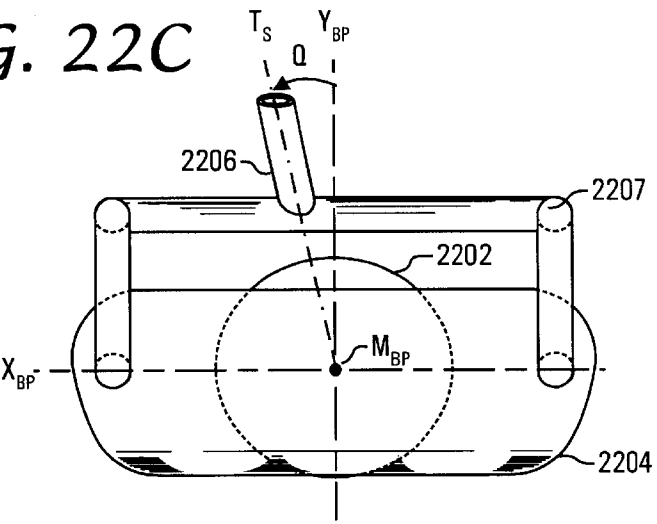
Figure 22B:
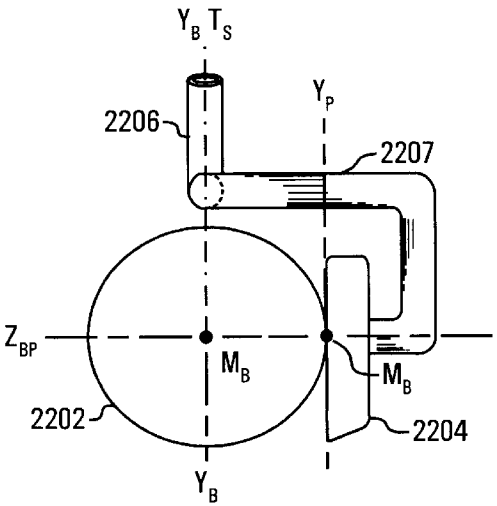

Turning now to FIGS. 22A–22C, view diagrams depicting a club head and configuration are presented in accordance with an exemplary embodiment of the present invention. Here, head 2204 is identical to that described above with respect to FIGS. 21A–21C and is aligned with ball 2202 in the same manner as discussed above. FIG. 22A is a plan view, FIG. 22B is a side view and FIG. 22C is a rear facing view of ball 2202 with head 2204. Shaft 2206 is oriented at shaft torque angle θ with the Y axis and is affixed to berish bracket 2207. The longitudinal member of berish bracket 2207 is positioned forward of the front face of head 2204 and forward of the rear face of head 2204 while the distal ends of the U-shaped configuration are attached to the rear extremities of head 2204, one distil end being attached between the moment of mass (head moment $M_p$) and the toe portion, and the second distil end is attached to the rear of head 2204 between the moment of mass (head moment $M_p$) and the heel portion.

Figure 23B:
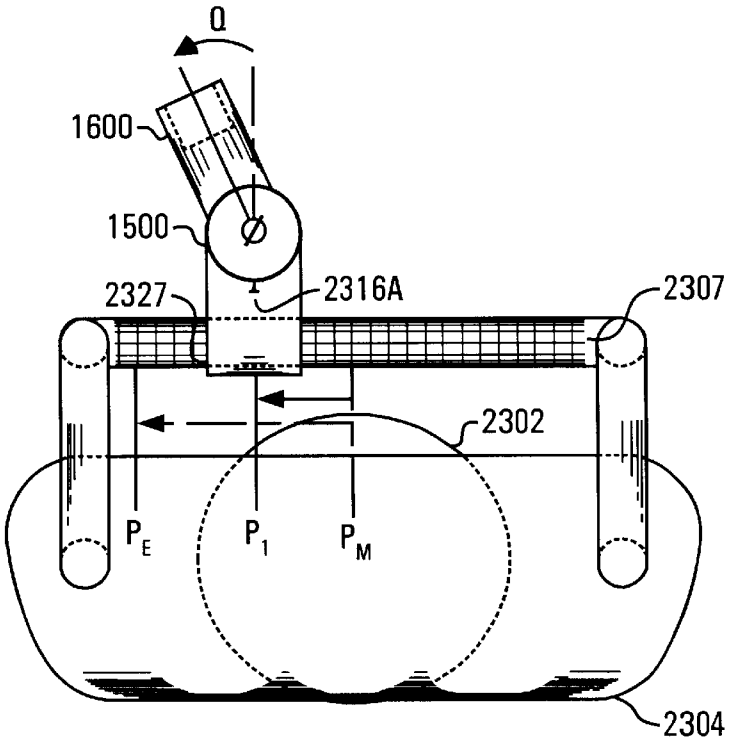
FIGS. 23A–23B are view diagrams of a club head and configuration with the longitudinal member positioned forward of the rear face of the club head and rear of the front face of the club head with an adjustment knuckle secured to a club head at the longitudinal member in accordance with an exemplary embodiment of the present invention.
Figure 23A:
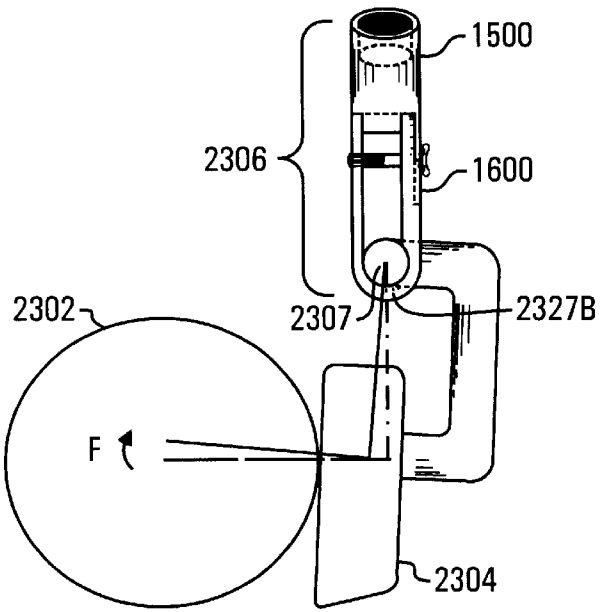

Turning now to FIGS. 23A–23B, view diagrams depicting a club head and configuration are presented in accordance with an exemplary embodiment of the present invention. Here, head 2304 is identical to that described above with respect to FIGS. 21A–21C and is aligned with ball 2302 in the same manner as discussed above. FIG. 23A is a side view and FIG. 23B is a rear facing view of ball 2302 with head 2304 Shaft 2306 is oriented at shaft torque angle θ with the Y axis and is affixed to berish bracket 2307. The longitudinal member of berish bracket 2307 is positioned substantially forward of the rear face and rear of the front face of head 2304, as also depicted above in FIG. 21, while either distal ends of the U-shaped configuration are attached to the rear extremities of head 2304, one distil end being attached between the moment of mass (head moment $M_p$) and the toe portion, and the second distil end is attached to the rear of head 2204 between the moment of mass (head moment $M_p$) and the heel portion.

FIGS. 23A and 23B further depict a knuckle secured to a club head using a berish bracket in accordance with an exemplary embodiment of the present invention. As seen in the illustrations, berish bracket 2307 is securely affixed to club head 2304 at either end while bracket adjustment part 1500 is compressed around the lateral shaft of bracket 2307. Shaft adjustment part 1600 is joined to bracket adjustment part 1500 as previously discussed with a shaft (not shown) extended upward. With respect to FIG. 23B, notice that indicators 2327 are etched into the lateral extent of berish bracket 2307, indicators 2327 are identical to those discussed above with regard to FIG. 18 composed of radial indices, depicted as vertical indicators, and linear indices that are depicted as horizontal indicators.

Figure 24B:
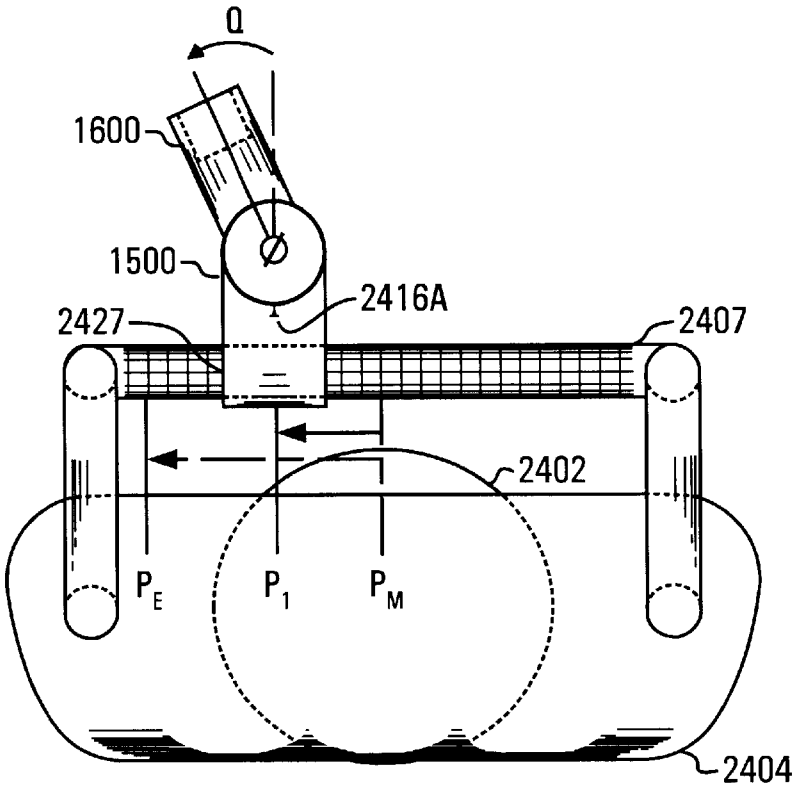
FIGS. 24A–24B are view diagrams of a club head and configuration with the longitudinal member positioned forward of the rear face of the club head with an adjustment knuckle secured to a club head at the longitudinal member in accordance with an exemplary embodiment of the present invention.
Figure 24A:
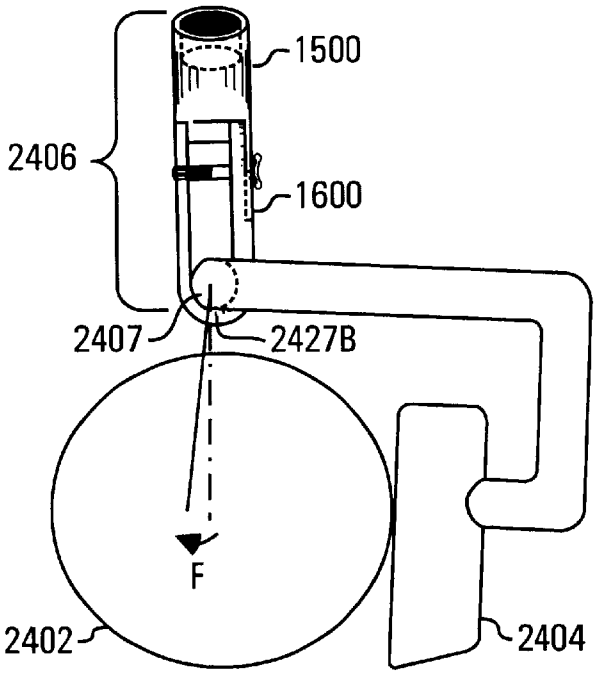

Turning now to FIGS. 24A–24B, view diagrams depicting a club head and configuration are presented in accordance with an exemplary embodiment of the present invention. Here, head 2404 is identical to that described above with respect to FIGS. 22A–22C and is aligned with ball 2402 in the same manner as discussed above. FIG. 24A is a side view and FIG. 24B is a rear facing view of ball 2402 with head 2404. Shaft 2406 is oriented at shaft torque angle θ with the Y axis and is affixed to berish bracket 2407. The longitudinal member of berish bracket 2407 is positioned forward of the front face of head 2404 and forward of the rear face of head 2404, as also depicted above in FIG. 22, while either distal ends of the U-shaped configuration are attached to the rear extremities of head 2404, one distil end being attached between the moment of mass (head moment $M_p$) and the toe portion, and the second distil end is attached to the rear of head 2404 between the moment of mass (head moment $M_p$) and the heel portion. FIGS. 24A and 24B further depict a knuckle secured to a club head using a berish bracket in accordance with another exemplary embodiment of the present invention as described above with respect to FIGS. 18 and 23.

The description of the present invention has been presented for purposes of illustration and description but is not intended to be exhaustive or limited to the invention in the form disclosed. Many modifications and variations will be apparent to those of ordinary skill in the art. The embodiment was chosen and described in order to best explain the principles of the invention and the practical application, and to enable others of ordinary skill in the art to understand the invention for various embodiments with various modifications as are suited to the particular use contemplated.

What is claimed is:

1. A stabilized golf club comprising:

a club head, said club head having a front face, a rear face, a toe portion, a heel portion and a moment of mass interposed between the toe portion and the heel portion;

a stabilization bracket, said stabilization bracket having a longitudinal member and two attachment members, wherein a first attachment member is attached to said club head between the moment of mass and the toe portion, and a second attachment member is attached to said club head between the moment of mass and the heel portion, and further wherein both of the first and second attachment members are attached to the longitudinal member, said longitudinal member is substantially linear, and said longitudinal member is positioned between the first attachment member the second attachment member, wherein the rear face is interposed between the front face and said longitudinal member and at least a portion of said longitudinal member being isolated from said club head;

an articulable joint, said articulable joint being articuably secured to said stabilization bracket; and a club shaft, said club shaft connected to said articulable joint.

2. The stabilized golf club recited in claim 1 above, wherein the articulable joint attached provides for configuration adjustments with three degree-of-adjustability.

3. The stabilized golf club recited in claim 2 above, wherein one degree-of-adjustment configures pitch of the club head and another degree-of-adjustment configures inclination of the club shaft.

4. The stabilized golf club recited in claim 2 above, wherein the stabilization bracket further comprises standardized measurement indicia, said standardized measurement indicia provides for calibrated adjustments in two degree-of-adjustment configuration.

5. The stabilized golf club recited in claim 1 above, wherein the stabilization bracket further comprises standardized measurement indicia, said standardized measurement indicia provides for calibrated two degree-of-adjustability configuration.

6. The stabilized golf club recited in claim 1 above, wherein at least a portion of said longitudinal member is approximately parallel with said rear face.

7. The stabilized golf club recited in claim 1 above, wherein the articulable joint attached provides for four degree-of-adjustability configuration.

8. The stabilized golf club recited in claim 7 above, wherein the stabilization bracket further comprises standardized measurement indicia, said standardized measurement indicia provides for calibrated adjustments in three degree-of-adjustment configuration.

9. The stabilized golf club recited in claim 7 above, wherein the articulable joint attached allows for provides for configuration adjustments in three degree-of-adjustability, wherein one degree-of-adjustment configures pitch of the club head and another degree-of-adjustment configures inclination of the club shaft and still another degree-of-adjustment configures the club head in the X direction wherever at least a portion of the longitudinal member is coplanar with an X axis plane.

10. The stabilized golf club recited in claim 9 above, wherein the stabilization bracket further comprises standardized measurement indicia, said standardized measurement indicia provides for calibrated adjustments in three degree-of-adjustment configuration.

11. The stabilized golf club recited in claim 1 above, wherein the articulable joint attached provides for configuration adjustments with three degree-of-adjustability and the stabilization bracket further comprises standardized measurement indicia, said standardized measurement indicia provides for calibrated three degree-of-adjustability configuration, said standardized measurement indicia being referenced in a configuration table.

12. The stabilized golf club recited in claim 11 above, wherein the configuration table represents a plurality of club configurations, each of said plurality of club configurations being referenced to said standardized measurement.

13. The stabilized golf club recited in claim 1 above, wherein the articulable joint attached provides for configuration adjustments with four degree-of-adjustability and the stabilization bracket further comprises standardized measurement indicia, said standardized measurement indicia provides for calibrated four degree-of-adjustability configuration, said standardized measurement indicia being referenced in a configuration table.

14. The stabilized golf club recited in claim 13 above, wherein the configuration table represents a plurality of club configurations, each of said plurality of club configurations being referenced to said standardized measurement.

15. The stabilized golf club recited in claim 1 above, wherein the club head further comprises:

an insert affixed to the front face, said insert comprised of one of balata, copper, milled face, aluminum, brass, bronze, titanium, composite material and layered material.

16. The stabilized golf club recited in claim 1 above, wherein the club head further comprises.

perimeter weights.

17. The stabilized golf club recited in claim 1 above, wherein said longitudinal member is substantially cylindrically shaped and said articulable joint being articulably secured to the substantially cylindrically shaped longitudinal member of said stabilization bracket.

18. The stabilized golf club recited in claim 1 above, said first attachment member is removeably attached to said club head, and a second attachment member is removeably attached to said club.

19. The stabilized golf club recited in claim 1 above, wherein said articulable joint further comprises:

a first articulating adjustment member, said first articulating adjustment member being articuably secured to a second articulating adjustment member.

20. A stabilized golf club comprising:

a club head, said club head having a front face, a rear face, a toe portion, a heel portion and a moment of mass interposed between the toe portion and the heel portion;

a stabilization bracket, said stabilization bracket having a longitudinal member from said club head and two attachment members, wherein at least a portion of said longitudinal member being offset from said club head, wherein further a first attachment member is attached to said club head between the moment of mass and the toe portion, and a second attachment member is attached to said club head between the moment of mass and the heel portion, and further wherein both of the first and second attachment members are attached to the longitudinal member and wherein said longitudinal member is substantially linear and positioned between the first attachment member the second attachment member, wherein the rear face is interposed between the front face and said longitudinal member; and a club shaft, said club shaft connected to said longitudinal member.

21. The stabilized golf club recited in claim 20 above, wherein at least a portion of said longitudinal member is approximately parallel with said rear face.

22. The stabilized golf club recited in claim 20 above, wherein said longitudinal member is substantially linear and positioned between the first attachment member the second attachment member, wherein the longitudinal member further positioned forward of the rear face and rear of the front face.

23. The stabilized golf club recited in claim 22 above, wherein at least a portion of said longitudinal member is approximately parallel with one of said front face and said rear face.

24. The stabilized golf club recited in claim 20 above, wherein at least a portion of said longitudinal member is approximately parallel with one of said front face and said rear face.

25. A stabilized golf club comprising:

a club head, said club head having a front face, a rear face, a toe portion, a heel portion and a moment of mass interposed between the toe portion and the heel portion;

a stabilization bracket, said stabilization bracket having a longitudinal member from said club head and two attachment members, wherein at least a portion of said longitudinal member being offset from said club head, wherein further a first attachment member is attached to said rear face of said club head between the moment of mass and the toe portion, and a second attachment member is attached to said rear face of said club head between the moment of mass and the heel portion, and further wherein both of the first and second attachment members are attached to the longitudinal member, wherein said longitudinal member is substantially linear and positioned between the first attachment member the second attachment member, and wherein the rear face is interposed between the front face and said longitudinal member; and a club shaft, said club shaft connected to said longitudinal member.

26. The stabilized golf club recited in claim 25 above, wherein at least a portion of said longitudinal member is approximately parallel with one of said front face and said rear face.

27. The stabilized golf club recited in claim 25 above, further comprises:

an articulable joint, said articulable joint being articuably secured to said stabilization bracket and provides for configuration adjustments with at least three degree-of-adjustability.

28. The stabilized golf club recited in claim 27 above, wherein the stabilization bracket further comprises standardized measurement indicia, said standardized measurement indicia provides for calibrated configuration in at least one degree-of-adjustability.

29. The stabilized golf club recited in claim 27 above, wherein the articulable joint further comprises standardized measurement indicia, said standardized measurement indicia provides for calibrated configuration in at least one degree-of-adjustability.

30. The stabilized golf club recited in claim 27 above, wherein one degree-of-adjustment configures pitch of the club head and another degree-of-adjustment configures inclination of the club shaft.

31. The stabilized golf club recited in claim 27 above, provides for configuration adjustments with four degree-of-adjustability.

32. The stabilized golf club recited in claim 31 above, wherein the stabilization bracket further comprises standardized measurement indicia, said standardized measurement indicia provides for calibrated configuration in at least one degree-of-adjustability.

33. The stabilized golf club recited in claim 31 above, wherein the articulable joint further comprises standardized measurement indicia, said standardized measurement indicia provides for calibrated configuration in at least one degree-of-adjustability.

34. The stabilized golf club recited in claim 27 above, wherein the articulable joint provides for configuration adjustments in three degree-of-adjustability, wherein one degree-of-adjustment configures pitch of the club head and another degree-of-adjustment configures inclination of the club shaft and still another degree-of-adjustment configures the club head in the X direction wherever at least a portion of the longitudinal member is oriented in an X axis plane.

35. The stabilized golf club recited in claim 34 above, wherein the articulable joint further comprises standardized measurement indicia, said standardized measurement indicia provides for calibrated configuration for at least one degree-of-adjustability.

36. The stabilized golf club recited in claim 45 above, wherein one degree-of-adjustment configures pitch of the club head and another degree-of-adjustment configures inclination of the club shaft.

37. The stabilized golf club recited in claim 27 above, wherein one of said articulable joint and said stabilization bracket further comprises standardized measurement indicia, said standardized measurement indicia provides for configuration adjustments in four degree-of-adjustability, said standardized measurement indicia being referenced to a configuration table.

38. The stabilized golf club recited in claim 37 above, wherein the configuration table represents a plurality of club configurations, each of said plurality of club configurations being referenced to said standardized measurement indicia.

39. The stabilized golf club recited in claim 27 above, wherein said longitudinal member is substantially cylindrically shaped and said articulable joint being articuably secured to the substantially cylindrically shaped longitudinal member of said stabilization bracket.

40. The stabilized golf club recited in claim 25 above, wherein the club head further comprises:

an insert affixed to the front face, said insert comprised of one of balata, copper, milled face, aluminum, brass, bronze, titanium, composite material and layered material.

41. The stabilized golf club recited in claim 25 above, wherein the club head further comprises:

perimeter weights.

42. The stabilized golf club recited in claim 25 above, said first attachment member is removeably attached to said club head, and a second attachment member is removeably attached to said club.

43. The stabilized golf club recited in claim 25 above, wherein said articulable joint further comprises:

a first articulating adjustment member; and a second articulating adjustment member, said first articulating adjustment member being articuably secured to the second articulating adjustment member.

44. The stabilized golf club recited in claim 43 above, wherein the first articulating adjustment member and the second articulating adjustment member, of said articulable joint, provides for configuration adjustments with at least five degree-of-adjustability.

45. The stabilized golf club recited in claim 44 above, wherein the first articulating adjustment member and the second articulating adjustment member, of said articulable joint, further comprises standardized measurement indicia, said standardized measurement indicia provides for configuration adjustments in at least three degree-of-adjustability.

46. The stabilized golf club recited in claim 45 above, wherein said standardized measurement indicia being referenced to a configuration table.

47. The stabilized golf club recited in claim 46 above, wherein the configuration table represents a plurality of club configurations, each of said plurality of club configurations being referenced to said standardized measurement indicia.

48. A stabilized golf club comprising:

a club head, said club head having a front face, a rear face, a toe portion, a heel portion and a moment of mass interposed between the toe portion and the heel portion;

a stabilization bracket, said stabilization bracket having a longitudinal member from said club head and two attachment members, wherein at least a portion of said longitudinal member being offset from said club head, wherein further a first attachment member is attached to said rear face of said club head between the moment of mass and the toe portion, and a second attachment member is attached to said rear face of said club head between the moment of mass and the heel portion, and further wherein both of the first and second attachment members are attached to said longitudinal member, and said longitudinal member is substantially linear and positioned between the first attachment member the second attachment member, wherein the longitudinal member further positioned forward of a plane defined by the rear face and rear of a plane defined by the front face and at least a portion of said longitudinal member is approximately parallel with one of said front face and said rear face; and a club shaft, said club shaft connected to said longitudinal member.

49. The stabilized golf club recited in claim 48 above, wherein at least a portion of said longitudinal member is approximately parallel with one of said front face and said rear face.

50. The stabilized golf club recited in claim 48 above, further comprises:

an articulable joint, said articulable joint being articuably secured to said stabilization bracket and provides for configuration adjustments with at least three degree-of-adjustability.

51. The stabilized golf club recited in claim 50 above, wherein the stabilization bracket further comprises standardized measurement indicia, said standardized measurement indicia provides for calibrated configuration in at least one degree-of-adjustability.

52. The stabilized golf club recited in claim 50 above, wherein the articulable joint further comprises standardized measurement indicia, said standardized measurement indicia provides for calibrated configuration in at least one degree-of-adjustability.

53. The stabilized golf club recited in claim 50 above, wherein one degree-of-adjustment configures pitch of the club head and another degree-of-adjustment configures inclination of the club shaft.

54. The stabilized golf club recited in claim 50 above, provides for configuration adjustments with four degree-of-adjustability.

55. The stabilized golf club recited in claim 54 above, wherein the stabilization bracket further comprises standardized measurement indicia, said standardized measurement indicia provides for calibrated configuration in at least one degree-of-adjustability.

56. The stabilized golf club recited in claim 54 above, wherein the articulable joint further comprises standardized measurement indicia, said standardized measurement indicia provides for calibrated configuration in at least one degree-of-adjustability.

57. The stabilized golf club recited in claim 50 above, wherein the articulable joint provides for configuration adjustments in three degree-of-adjustability, wherein one degree-of-adjustment configures pitch of the club head and another degree-of-adjustment configures inclination of the club shaft and still another degree-of-adjustment configures the club head in the X direction wherever at least a portion of the longitudinal member is oriented in an X axis plane.

58. The stabilized golf club recited in claim 57 above, wherein the articulable joint further comprises standardized measurement indicia, said standardized measurement indicia provides for calibrated configuration for at least one degree-of-adjustability.

59. The stabilized golf club recited in claim 57 above, wherein one degree-of-adjustment configures pitch of the club head and another degree-of-adjustment configures inclination of the club shaft.

60. The stabilized golf club recited in claim 50 above, wherein one of said articulable joint and said stabilization bracket further comprises standardized measurement indicia, said standardized measurement indicia provides for configuration adjustments in three degree-of-adjustability, said standardized measurement indicia being referenced to a configuration table.

61. The stabilized golf club recited in claim 60 above, wherein the configuration table represents a plurality of club configurations, each of said plurality of club configurations being referenced to said standardized measurement indicia.

62. The stabilized golf club recited in claim 50 above, wherein one of said articulable joint and said stabilization bracket further comprises standardized measurement indicia, said standardized measurement indicia provides for configuration adjustments in four degree-of-adjustability, said standardized measurement indicia being referenced to a configuration table.

63. The stabilized golf club recited in claim 62 above, wherein the configuration table represents a plurality of club configurations, each of said plurality of club configurations being referenced to said standardized measurement indicia.

64. The stabilized golf club recited in claim 50 above, wherein said longitudinal member is substantially cylindrically shaped and said articulable joint being articuably secured to the substantially cylindrically shaped longitudinal member of said stabilization bracket.

65. The stabilized golf club recited in claim 48 above, wherein the club head further comprises:

an insert affixed to the front face, said insert comprised of one of balata, copper, milled face, aluminum, brass, bronze, titanium, composite material and layered material.

66. The stabilized golf club recited in claim 48 above, wherein the club head further comprises:

perimeter weights.

67. The stabilized golf club recited in claim 48 above, said first attachment member is removeably attached to said club head, and a second attachment member is removeably attached to said club.

68. The stabilized golf club recited in claim 48 above, wherein said articulable joint further comprises:

a first articulating adjustment member; and a second articulating adjustment member, said second articulating adjustment member being articuably secured to the first articulating adjustment member.

69. The stabilized golf club recited in claim 68 above, wherein the first articulating adjustment member and the second articulating adjustment member, of said articulable joint, provides for configuration adjustments with at least five degree-of-adjustability.

70. The stabilized golf club recited in claim 69 above, wherein the first articulating adjustment member and the second articulating adjustment member, of said articulable joint, further comprises standardized measurement indicia, said standardized measurement indicia provides for configuration adjustments in at least three degree-of-adjustability.

71. The stabilized golf club recited in claim 70 above, wherein said standardized measurement indicia being referenced to a configuration table.

72. The stabilized golf club recited in claim 71 above, wherein the configuration table represents a plurality of club configurations, each of said plurality of club configurations being referenced to said standardized measurement indicia.

73. A stabilized golf club comprising:

a club head, said club head having a front face, a rear face, a toe portion, a heel portion and a moment of mass interposed between the toe portion and the heel portion;

a stabilization bracket, said stabilization bracket having a longitudinal member from said club head and two attachment members, wherein at least a portion of said longitudinal member being offset from said club head, wherein further a first attachment member is attached to said rear face of said club head between the moment of mass and the toe portion, and a second attachment member is attached to said rear face of said club head between the moment of mass and the heel portion, and further wherein both of the first and second attachment members are attached to said longitudinal member, and said longitudinal member is substantially linear and positioned between the first attachment member the second attachment member, wherein the longitudinal member further positioned forward of a plane defined by the front face and at least a portion of said longitudinal member is approximately parallel with one of said front face and said rear face; and a club shaft, said club shaft connected to said longitudinal member.

74. The stabilized golf club recited in claim 73 above, wherein at least a portion of said longitudinal member is approximately parallel with one of said front face and said rear face.

75. The stabilized golf club recited in claim 73 above, further comprises:

an articulable joint, said articulable joint being articuably secured to said stabilization bracket and provides for configuration adjustments with at least three degree-of-adjustability.

76. The stabilized golf club recited in claim 75 above, wherein the stabilization bracket further comprises standardized measurement indicia, said standardized measurement indicia provides for calibrated configuration in at least one degree-of-adjustability.

77. The stabilized golf club recited in claim 75 above, wherein the articulable joint further comprises standardized measurement indicia, said standardized measurement indicia provides for calibrated configuration in at least one degree-of-adjustability.

78. The stabilized golf club recited in claim 75 above, wherein one degree-of-adjustment configures pitch of the club head and another degree-of-adjustment configures inclination of the club shaft.

79. The stabilized golf club recited in claim 75 above, provides for configuration adjustments with four degree-of-adjustability.

80. The stabilized golf club recited in claim 79 above, wherein the stabilization bracket further comprises standardized measurement indicia, said standardized measurement indicia provides for calibrated configuration in at least one degree-of-adjustability.

81. The stabilized golf club recited in claim 79 above, wherein the articulable joint further comprises standardized measurement indicia, said standardized measurement indicia provides for calibrated configuration in at least one degree-of-adjustability.

82. The stabilized golf club recited in claim 75 above, wherein the articulable joint provides for configuration adjustments in three degree-of-adjustability, wherein one degree-of-adjustment configures pitch of the club head and another degree-of-adjustment configures inclination of the club shaft and still another degree-of-adjustment configures the club head in the X direction wherever at least a portion of the longitudinal member is oriented in an X axis plane.

83. The stabilized golf club recited in claim 82 above, wherein the articulable joint further comprises standardized measurement indicia, said standardized measurement indicia provides for calibrated configuration for at least one degree-of-adjustability.

84. The stabilized golf club recited in claim 82 above, wherein one degree-of-adjustment configures pitch of the club head and another degree-of-adjustment configures inclination of the club shaft.

85. The stabilized golf club recited in claim 75 above, wherein one of said articulable joint and said stabilization bracket further comprises standardized measurement indicia, said standardized measurement indicia provides for configuration adjustments in three degree-of-adjustability, said standardized measurement indicia being referenced to a configuration table.

86. The stabilized golf club recited in claim 85 above, wherein the configuration table represents a plurality of club configurations, each of said plurality of club configurations being referenced to said standardized measurement indicia.

87. The stabilized golf club recited in claim 75 above, wherein one of said articulable joint and said stabilization bracket further comprises standardized measurement indicia, said standardized measurement indicia provides for configuration adjustments in four degree-of-adjustability, said standardized measurement indicia being referenced to a configuration table.

88. The stabilized golf club recited in claim 87 above, wherein the configuration table represents a plurality of club configurations, each of said plurality of club configurations being referenced to said standardized measurement indicia.

89. The stabilized golf club recited in claim 75 above, wherein said longitudinal member is substantially cylindrically shaped and said articulable joint being articuably secured to the substantially cylindrically shaped longitudinal member of said stabilization bracket.

90. The stabilized golf club recited in claim 73 above, wherein the club head further comprises:

an insert affixed to the front face, said insert comprised of one of balata, copper, milled face, aluminum, brass, bronze, titanium, composite material and layered material.

91. The stabilized golf club recited in claim 73 above, wherein the club head further comprises:

perimeter weights.

92. The stabilized golf club recited in claim 73 above, said first attachment member is removeably attached to said club head, and a second attachment member is removeably attached to said club.

93. The stabilized golf club recited in claim 73 above, wherein said articulable joint further comprises:

a first articulating adjustment member; and a second articulating adjustment member, said second articulating adjustment member being articuably secured to the first articulating adjustment member.

94. The stabilized golf club recited in claim 93 above, wherein the first articulating adjustment member and the second articulating adjustment member, of said articulable joint, provides for configuration adjustments with at least five degree-of-adjustability.

95. The stabilized golf club recited in claim 93 above, wherein the first articulating adjustment member and the second articulating adjustment member, of said articulable joint, further comprises standardized measurement indicia, said standardized measurement indicia provides for configuration adjustments in at least three degree-of-adjustability.

96. The stabilized golf club recited in claim 95 above, wherein said standardized measurement indicia being referenced to a configuration table.

97. The stabilized golf club recited in claim 96 above, wherein the configuration table represents a plurality of club configurations, each of said plurality of club configurations being referenced to said standardized measurement indicia.

98. A stabilized golf club comprising:

a club head, said club head having a front face, a rear face, a toe portion, a heel portion and a moment of mass interposed between the toe portion and the heel portion;

a stabilization bracket, said stabilization bracket having a longitudinal member and two attachment members, wherein a first attachment member is attached to said club head between the moment of mass and the toe portion, and a second attachment member is attached to said club head between the moment of mass and the heel portion, and further wherein both of the first and second attachment members are attached to the longitudinal member, wherein said longitudinal member is substantially linear and positioned between the first attachment member and the second attachment member, wherein the longitudinal member further positioned forward of the rear face and rear of the front face and at least a portion of said longitudinal member being isolated from said club head;

an articulable joint, said articulable joint being articuably secured to said stabilization bracket and articulable joint provides for four degree-of-adjustability configuration; and a club shaft, said club shaft connected to said articulable joint.

99. The stabilized golf club recited in claim 98 above, wherein the articulable joint attached provides for configuration adjustments with three degree-of-adjustability.

100. The stabilized golf club recited in claim 98 above, wherein the stabilization bracket further comprises standardized measurement indicia, said standardized measurement indicia provides for calibrated two degree-of-adjustability configuration.

101. The stabilized golf club recited in claim 100 above, wherein the stabilization bracket further comprises standardized measurement indicia, said standardized measurement indicia provides for calibrated adjustments in two degree-of-adjustment configuration.

102. The stabilized golf club recited in claim 98 above, wherein at least a portion of said longitudinal member is approximately parallel with one of said front face and said rear face.

103. The stabilized golf club recited in claim 98 above, wherein one degree-of-adjustment configures pitch of the club head and another degree-of-adjustment configures inclination of the club shaft.

104. The stabilized golf club recited in claim 98 above, wherein the stabilization bracket further comprises standardized measurement indicia, said standardized measurement indicia provides for calibrated configuration in at least one degree-of-adjustability.

105. The stabilized golf club recited in claim 98 above, wherein the articulable joint further comprises standardized measurement indicia, said standardized measurement indicia provides for calibrated configuration in at least one degree-of-adjustability.

106. The stabilized golf club recited in claim 98 above, wherein the articulable joint attached allows for provides for configuration adjustments in three degree-of-adjustability, wherein one degree-of-adjustment configures pitch of the club head and another degree-of-adjustment configures inclination of the club shaft and still another degree-of-adjustment configures the club head in the X direction wherever at least a portion of the longitudinal member is coplanar with an X axis plane.

107. The stabilized golf club recited in claim 106 above, wherein the stabilization bracket further comprises standardized measurement indicia, said standardized measurement indicia provides for calibrated configuration in at least one degree-of-adjustability.

108. The stabilized golf club recited in claim 106 above, wherein the articulable joint further comprises standardized measurement indicia, said standardized measurement indicia provides for calibrated configuration in at least one degree-of-adjustability.

109. The stabilized golf club recited in claim 98 above, wherein the club head further comprises:

an insert affixed to the front face, said insert comprised of one of balata, copper, milled face, aluminum, brass, bronze, titanium, composite material and layered material.

110. The stabilized golf club recited in claim 98 above, wherein the club head further comprises:

perimeter weights.

111. The stabilized golf club recited in claim 98 above, wherein one of said articulable joint and said stabilization bracket further comprises standardized measurement indicia, said standardized measurement indicia provides for configuration adjustments in three degree-of-adjustability, said standardized measurement indicia being referenced to a configuration table.

112. The stabilized golf club recited in claim 111 above, wherein the configuration table represents a plurality of club configurations, each of said plurality of club configurations being referenced to said standardized measurement indicia.

113. The stabilized golf club recited in claim 98 above, wherein one of said articulable joint and said stabilization bracket further comprises standardized measurement indicia, said standardized measurement indicia provides for configuration adjustments in four degree-of-adjustability, said standardized measurement indicia being referenced to a configuration table.

114. The stabilized golf club recited in claim 113 above, wherein the configuration table represents a plurality of club configurations, each of said plurality of club configurations being referenced to said standardized measurement indicia.

115. The stabilized golf club recited in claim 98 above, wherein said longitudinal member is substantially cylindrically shaped and said articulable joint being articuably secured to the substantially cylindrically shaped longitudinal member of said stabilization bracket.

116. The stabilized golf club recited in claim 98 above, wherein said articulable joint further comprises:

a first articulating adjustment member; and a second articulating adjustment member, said second articulating adjustment member being articuably secured to the first articulating adjustment member.

117. The stabilized golf club recited in claim 116 above, wherein the first articulating adjustment member and the second articulating adjustment member, of said articulable joint, provides for configuration adjustments with at least five degree-of-adjustability.

118. The stabilized golf club recited in claim 117 above, wherein the first articulating adjustment member and the second articulating adjustment member, of said articulable joint, further comprises standardized measurement indicia, said standardized measurement indicia provides for configuration adjustments in at least three degree-of-adjustability.

119. The stabilized golf club recited in claim 118 above, wherein said standardized measurement indicia being referenced to a configuration table.

120. The stabilized golf club recited in claim 119 above, wherein the configuration table represents a plurality of club configurations, each of said plurality of club configurations being referenced to said standardized measurement indicia.

* * * * *